US008353577B2

(12) United States Patent
McAvoy et al.

(10) Patent No.: US 8,353,577 B2
(45) Date of Patent: Jan. 15, 2013

(54) METHOD OF CONTROLLING DROP DIRECTIONALITY FROM INKJET NOZZLE USING MULTIPLE INDEPENDENTLY-ACTUABLE ROOF PADDLES

(75) Inventors: Gregory John McAvoy, Dublin (IE); Emma Rose Kerr, Dublin (IE); Rónán Pádraig Seán O'Reilly, Dublin (IE); Vincent Patrick Lawlor, Dublin (IE); Misty Bagnat, Dublin (IE)

(73) Assignee: Zamtec Ltd, Dublin (IE)

( * ) Notice: Subject to any disclaimer, the term of this patent is extended or adjusted under 35 U.S.C. 154(b) by 175 days.

(21) Appl. No.: 12/895,863

(22) Filed: Oct. 1, 2010

(65) Prior Publication Data

US 2012/0081470 A1 Apr. 5, 2012

(51) Int. Cl.
*B41J 2/05* (2006.01)

(52) U.S. Cl. ..... 347/57; 347/47; 347/54

(58) Field of Classification Search ..... 347/5, 9–11, 347/15, 20, 40, 42, 44, 47, 48, 54, 56–59, 347/61–65, 67
See application file for complete search history.

(56) References Cited

U.S. PATENT DOCUMENTS 6,726,308 B2 * 4/2004 Lee et al. ..... 347/48
7,530,668 B2 * 5/2009 Tomita et al. ..... 347/47

* cited by examiner

*Primary Examiner* — Juanita D Jackson

(57) ABSTRACT

A method of controlling a direction of droplet ejection from an inkjet nozzle having a plurality of moveable paddles, the method includes the steps of: (i) actuating a first thermal bend actuator via respective first drive circuitry such that a respective first paddle bends towards a floor of the nozzle chamber; (ii) actuating a second thermal bend actuator via respective second drive circuitry such that a respective second paddle bends towards a floor of the nozzle chamber; and (iii) thereby ejecting a droplet of ink. Actuation of the first and second thermal bend actuators is independently controlled via the first and second drive circuitry so as to control the direction of droplet ejection.

18 Claims, 22 Drawing Sheets

METHOD OF CONTROLLING DROP DIRECTIONALITY FROM INKJET NOZZLE USING MULTIPLE INDEPENDENTLY-ACTUABLE ROOF PADDLES

FIELD OF THE INVENTION

The present invention relates to the field of printers and particularly inkjet printheads. It has been developed primarily to improve print quality and printhead performance in high resolution printheads.

COPENDING APPLICATIONS

The following U.S. applications have been filed by the Applicant simultaneously with the present application:

| | | | | |
|---|---|---|---|---|
| 12/895,856, | 12/895,857, | 12/895,858, | 12/895,859, | 12/895,860, |
| 12/895,861, | 12/895,862, | 12/895,864, | 12/895,865, | 12/895,866, |
| 12/895,867 | | | | |

The disclosures of these co-pending applications are incorporated herein by reference.

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.'

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

The present Applicant has disclosed a plethora of pagewidth printhead designs. Stationary page with printheads, which extend across a width of a page, present a number of unique design challenges when compared with more conventional traversing inkjet printheads. For example, pagewidth printheads are typically built up from a plurality of individual printhead integrated circuits (ICs), which must be joined seamlessly to provide high print quality. The present Applicant has hitherto described printheads having a displaced section of nozzles, which enables nozzle rows to print seamlessly between abutting printhead integrated circuits spanning across a pagewidth (see U.S. Pat. Nos. 7,390,071 and 7,290,852, the contents of which are herein incorporated by reference). Other approaches to pagewidth printing (e.g. HP Edgeline™ Technology) employ staggered printhead modules, which inevitably increase the size of the print zone and place additional demands on media feed mechanisms in order to maintain proper alignment with the print zone. It would be desirable to provide an alternative nozzle design, which enables a new approach to the construction of pagewidth printheads.

Typically, pagewidth printheads include 'redundant' nozzle rows, which may be used for dead nozzle compensation or for modulating a peak power requirement of the printhead (see U.S. Pat. Nos. 7,465,017 and 7,252,353, the contents of which are herein incorporated by reference). Dead nozzle compensation is a particular problem in stationary pagewidth printheads, in contrast with traversing printheads, because the media substrate only makes a single pass of each nozzle in the printhead during printing. Redundancy inevitably increases the cost and complexity of pagewidth printheads, and it would be desirable to minimize redundant nozzle row(s) whilst still providing adequate mechanisms for dead nozzle compensation.

It would be further desirable to provide more versatile pagewidth printheads, which are able to control, for example, drop placement and/or dot resolution.

It would be further desirable to provide printheads with alternative integration of MEMS and CMOS layers. It would be especially desirable to minimize the undesirable phenomenon of 'ground bounce' and thereby improve the overall electrical efficiency of printheads.

SUMMARY OF THE INVENTION

In a first aspect, there is provided an inkjet nozzle assembly comprising:

a nozzle chamber for containing ink, the nozzle chamber comprising a floor and a roof having a nozzle opening defined therein; and a plurality of moveable paddles defining at least part of the roof, the plurality of paddles being actuable to cause ejection of an ink droplet from the nozzle opening, each paddle including a thermal bend actuator comprising:

an upper thermoelastic beam connected to drive circuitry; and a lower passive beam fused to the thermoelastic beam, such that when a current is passed through the thermoelastic beam, the thermoelastic beam expands relative to the passive beam, resulting in bending of a respective paddle towards the floor of the nozzle chamber, wherein each actuator is independently controllable via respective drive circuitry such that a direction of droplet ejection from the nozzle opening is controllable by independent movement of each paddle.

As used herein, the term "nozzle assembly" and "nozzle" are used interchangeably. Thus, a "nozzle assembly" or "nozzle" refers to a device which ejects droplets of ink upon actuation. The "nozzle assembly" or "nozzle" usually comprises a nozzle chamber having a nozzle opening and at least one actuator.

Optionally, the nozzle assembly is disposed on a substrate, and wherein a passivation layer of the substrate defines the floor of the nozzle chamber.

Optionally, the roof is spaced apart from the floor and sidewalls extend between the roof and the floor to define the nozzle chamber.

Optionally, the nozzle assembly comprises a pair of opposed paddles positioned on either side of the nozzle opening.

Optionally, the nozzle assembly comprises two pairs of opposed paddles positioned relative to the nozzle opening.

Optionally, the paddles are moveable relative to the nozzle opening.

Optionally, each paddle defines a segment of the nozzle opening such that the nozzle opening and the paddles are moveable relative to the floor.

Optionally, the thermoelastic beam is comprised of a vanadium-aluminium alloy.

Optionally, the passive beam is comprised of at least one material selected from the group consisting of: silicon oxide, silicon nitride and silicon oxynitride.

Optionally, the passive beam comprises a first upper passive beam comprised of silicon oxide and a second lower passive beam comprised of silicon nitride.

Optionally, the roof is coated with a polymeric material. The polymeric material may be configured to provide a mechanical seal between each paddle and a stationary part of the roof, thereby minimizing ink leakage during actuation of the paddles. Alternatively, the polymeric material may have openings defined therein such that there is a fluidic seal between each paddle and a stationary part of the roof.

Optionally, the polymeric material is comprised of a polymerized siloxane.

Optionally, the polymerized siloxane is selected from the group consisting of: polysilsesquioxanes and polydimethylsiloxane.

Optionally, the actuators are independently controllable by controlling at least one of:

a timing of drive signals to each of the actuators so as to provide a coordinated movement of the plurality of paddles; and a power of drive signals to each of the actuators.

Optionally, the power of drive signals is controlled by at least one of:

a voltage of the drive signals; and a pulse width of the drive signals.

In a further aspect related to the first aspect, there is provided an inkjet printhead integrated circuit comprising:

a substrate comprising drive circuitry; and a plurality of inkjet nozzle assemblies disposed on the substrate, each inkjet nozzle assembly comprising:

a nozzle chamber for containing ink, the nozzle chamber comprising a floor defined by an upper surface of the substrate and a roof having a nozzle opening defined therein; and a plurality of moveable paddles defining at least part of the roof, the plurality of paddles being actuable to cause ejection of an ink droplet from the nozzle opening, each paddle including a thermal bend actuator comprising:

an upper thermoelastic beam connected to the drive circuitry; and a lower passive beam fused to the thermoelastic beam, such that when a current is passed through the thermoelastic beam, the thermoelastic beam expands relative to the passive beam, resulting in bending of a respective paddle towards the floor of the nozzle chamber, wherein each actuator is independently controllable via respective drive circuitry such that a direction of droplet ejection from the nozzle opening is controllable by independent movement of each paddle.

Optionally, the upper surface of the substrate is defined by a passivation layer, the passivation layer being disposed on a drive circuitry layer.

In a second aspect, there is provided a stationary pagewidth inkjet printhead comprised of a plurality of printhead integrated circuits butted end-on-end across the pagewidth, the printhead comprising one or more nozzle rows extending along a longitudinal axis of the printhead, each nozzle row comprising a plurality of nozzles, wherein one or more of the nozzles are each configured to fire a droplet of ink at a plurality of predetermined different dot positions along the longitudinal axis.

Optionally, the one or more nozzles are each configurable to fire a droplet of ink at 2, 3, 4, 5, 6 or 7 different dot positions along the longitudinal axis.

Optionally, each nozzle is configurable to fire a droplet of ink at a plurality of predetermined different dot positions within a two-dimensional zone having predetermined dimensions.

Optionally, the zone is substantially circular or substantially elliptical, and wherein a centroid of the zone corresponds with a centroid of the nozzle.

Optionally, the one or more nozzles are configurable to fire a droplet of ink at a primary dot position and at least one secondary dot position on either side of the primary dot position.

Optionally, each nozzle in a first set is configured to fire a droplet of ink at a plurality of predetermined different dot positions along the longitudinal axis, each nozzle in the first set being positioned within two nozzle pitches of a dead nozzle in the printhead, wherein one nozzle pitch is defined as a minimum longitudinal distance between a pair of nozzles in the same nozzle row.

Optionally, each nozzle in a nozzle row is configured to fire a droplet of ink at a plurality of predetermined different dot positions along the longitudinal axis, such that a printed dot density exceeds a nozzle density of the printhead.

Optionally, each butting pair of printhead integrated circuits defines a join region, and wherein a nozzle pitch across the join region exceeds one nozzle pitch, one nozzle pitch being defined as a minimum longitudinal distance between a pair of nozzles in the same nozzle row.

Optionally, wherein each nozzle in a second set is configured to fire a droplet of ink at a plurality of predetermined different dot positions along the longitudinal axis, the plurality of predetermined dot positions including at least one dot position within the join region.

In a third aspect, there is provided a stationary pagewidth inkjet printhead comprising one or more nozzle rows extending along a longitudinal axis of the printhead, wherein each nozzle is configured to fire a droplet of ink at a plurality of predetermined different dot positions along the longitudinal axis, such that a printed dot density exceeds a nozzle density of the printhead.

Optionally, each nozzle is configurable to fire a droplet of ink at 2, 3, 4, 5, 6 or 7 different dot positions along the longitudinal axis.

Optionally, each nozzle is configurable to fire a droplet of ink at a plurality of predetermined different dot positions along a transverse axis of the printhead.

Optionally, the printed dot density is at least twice the nozzle density of the printhead.

Optionally, each nozzle is configured to fire more than once within one line-time, wherein one line-time is defined as the time taken for a print medium to advance past the printhead by one line.

In a fourth aspect, there is provided a stationary pagewidth inkjet printhead comprising one or more nozzle rows extending along a longitudinal axis of the printhead, wherein each nozzle is configurable to fire a droplet of ink at a plurality of predetermined different dot positions along the longitudinal axis, each nozzle having a primary dot position associated therewith, wherein the printhead is configured to compensate for a dead nozzle by printing from a selected functioning nozzle positioned in a same nozzle row as the dead nozzle, the selected functioning nozzle being configured to fire at least some ink droplets at the primary dot position associated with the dead nozzle and to fire at least some ink droplets at its own primary dot position.

Optionally, the selected functioning nozzle is positioned at a distance of one, two, three or four nozzle pitches away from the dead nozzle, wherein one nozzle pitch is defined as a minimum longitudinal distance between a pair of nozzles in the same nozzle row.

Optionally, the printhead is configured to compensate for the dead nozzle by the steps of:

identifying the dead nozzle;

selecting a functioning nozzle to compensate for the dead nozzle; and configuring the selected functioning nozzle to fire at least some ink droplets at the primary dot position associated with the dead nozzle.

Optionally, the selected functioning nozzle is configured to fire a first ink droplet at the primary dot position associated with the dead nozzle and to fire a second ink droplet at its own primary dot position within a period of one line-time, wherein one line-time is defined as the time taken for a print medium to advance past the printhead by one line.

Optionally, each nozzle is further configurable to fire a droplet of ink at a plurality of predetermined different dot positions along a transverse axis of the printhead.

Optionally, the selected functioning nozzle is configured to fire a first ink droplet at the primary dot position associated with the dead nozzle and to fire a second ink droplet at its own primary dot position in a period of more than one line-time and less than five line-times.

Optionally, each droplet ejected perpendicular to an ink ejection face of the printhead results in landing the droplet at a respective primary dot position.

Optionally, the printhead is configured to compensate for a plurality of dead nozzles by printing from a corresponding plurality of selected functioning nozzles.

Optionally, the printhead has no redundant nozzle rows.

In a further aspect related to the fourth aspect, there is provided a printhead integrated circuit for a stationary pagewidth inkjet printhead, the printhead integrated circuit comprising one or more nozzle rows extending along a longitudinal axis thereof, wherein each nozzle is configured to fire a droplet of ink at a plurality of predetermined different dot positions along the longitudinal axis, each nozzle having a primary dot position associated therewith, wherein the printhead integrated circuit is configured to compensate for a dead nozzle by printing from a selected functioning nozzle positioned in a same nozzle row as the dead nozzle, the selected functioning nozzle being configured to fire at least some ink droplets at the primary dot position associated with the dead nozzle and to fire at least some ink droplets at its own primary dot position.

In a fifth aspect, there is provided a stationary pagewidth inkjet printhead comprising one or more nozzle rows extending along a longitudinal axis of the printhead, the printhead being comprised of a plurality of printhead modules having first and second opposite ends butted across a width of a page, each butting pair of printhead modules defining a common join region, wherein a nozzle pitch across the join region exceeds one nozzle pitch, one nozzle pitch being defined as a minimum longitudinal distance between a pair of nozzles in a same nozzle row, and wherein at least one first nozzle positioned at the first end of a first printhead module in a butting pair is configured to fire ink droplets into a respective join region.

Optionally, at least one second nozzle positioned at the second end of a second printhead module in the butting pair is configured to fire ink droplets into the respective join region, such that first and second nozzles from opposed first and second ends of abutting printhead modules fire ink droplets into the common join region.

Optionally, each first nozzle is configured to fire a droplet of ink at a plurality of predetermined different dot positions along the longitudinal axis, the plurality of predetermined different dot positions including at least one dot position within the join region.

Optionally, each first and second nozzle is configured to fire respective droplets of ink at a respective plurality of predetermined different dot positions along the longitudinal axis, each respective plurality of predetermined different dot positions including at least one dot position within the join region.

Optionally, a dot pitch in the join region is substantially the same as one nozzle pitch.

Optionally, each first and second nozzle is configured to fire more than once within a period of one line-time, wherein one line-time is defined as the time taken for a print medium to advance past the printhead by one line.

Optionally, nozzles positioned towards the first end are configured to fire droplets of ink skewed towards the first end and nozzles positioned towards the second end are configured to fire droplets of ink skewed towards the second end.

Optionally, a degree of skew is dependent on a distance of each nozzle from a centre of a respective printhead module, such that nozzles positioned nearer to the centre fire droplets of ink skewed less than nozzles positioned further from the centre.

Optionally, an average dot pitch is greater than one nozzle pitch.

Optionally, the average dot pitch is less than 1% greater than one nozzle pitch.

Optionally, each nozzle in the printhead is configured to fire droplets of ink at only one dot position unless compensating for a dead nozzle.

In a sixth aspect, there is provided a printhead integrated circuit (IC) comprising one or more nozzle rows extending along a longitudinal axis thereof, the printhead IC having first and second ends for butting engagement with other printhead ICs so as to define a pagewidth printhead, each nozzle having a primary dot position associated therewith, wherein at least one first nozzle positioned at the first end is configured to fire at least some ink droplets skewed towards the first end in addition to firing at least some ink droplets at its own primary dot position.

Optionally, at least one second first nozzle positioned at the second end is configured to fire at least some ink droplets skewed towards the second end in addition to firing at least some ink droplets at its own primary dot position.

Optionally, the first nozzle is configured to fire one ink droplet skewed towards the first end and to fire one ink droplet at its own primary dot position within a period of one line-time or less, wherein one line-time is defined as the time taken for a print medium to advance past the printhead IC by one line.

Optionally, each second nozzle is configured to fire one ink droplet skewed towards the second end and to fire one ink droplet at its own primary dot position within a period of one line-time or less.

Optionally, a nozzle pitch of the printhead IC is the same as a dot pitch of printed dots, wherein the nozzle pitch of the printhead IC is defined as a longitudinal distance between a pair of nozzles in a same nozzle row and the dot pitch is defined as a longitudinal distance between a pair of dots in a same line of printing.

Optionally, the first nozzle is configured to fire at least some ink droplets skewed towards the first end by a distance of between 1 and 3 nozzle pitches.

Optionally, each nozzle row extends between a first join region at the first end and a second join region at the second end.

Optionally, the first and second join regions have a width defined as a minimum distance between an edge of the printhead IC and a nozzle.

Optionally, the first join region has a width of between 0.5 and 3.5 nozzle pitches, and the second join region has a width of between 0.5 and 3.5 nozzle pitches.

Optionally, a printable zone of at least one nozzle row is longer than a longitudinal extent of the nozzle row when the printhead IC is stationary.

In a seventh aspect, there is provided a printhead integrated circuit (IC) for a stationary pagewidth printhead, the printhead IC comprising at least one nozzle row extending along a longitudinal axis thereof, wherein a length of a printable zone corresponding to the nozzle row is longer than a length of the nozzle row.

Optionally, the length of the printable zone is at least one nozzle pitch longer than the length of the nozzle row, wherein one nozzle pitch is defined as a minimum longitudinal distance between a pair of nozzles in the nozzle row.

Optionally, the printable zone is up to eight nozzle pitches longer than the nozzle row.

Optionally, the printable zone corresponds to a line of dots printed by the nozzle row.

Optionally, the printhead comprises a plurality of nozzle rows, wherein a length of the printable zone corresponding to each of the nozzle rows is longer than a length of each nozzle row.

Optionally, the printable zone extends beyond each of end of the nozzle row.

Optionally, at least one first nozzle positioned at a first end of the printhead IC is configured to fire ink droplets skewed towards the first end.

Optionally, a degree of skew is dependent on a distance of each nozzle from the first end, such that nozzles positioned nearer to the first end fire droplets of ink skewed more towards the first end than nozzles positioned further from the first end.

Optionally, at least one second nozzle positioned at an opposite second end of the printhead IC is configured to fire ink droplets skewed towards the second end.

Optionally, a degree of skew is dependent on a distance of each nozzle from a centre of the printhead IC, such that nozzles positioned nearer to the centre fire droplets of ink skewed less than nozzles positioned further from the centre.

Optionally, nozzles positioned in a centre region of the printhead IC are configured to fire ink droplets substantially perpendicularly with respect to an ink ejection face of the printhead IC.

Optionally, an average dot pitch in the printable zone is greater than one nozzle pitch.

Optionally, the average dot pitch is less than 1% greater than one nozzle pitch.

Optionally, each nozzle in the printhead is configured to fire droplets of ink at only one dot position unless compensating for a dead nozzle.

In an eighth aspect, there is provided a method of controlling a direction of droplet ejection from an inkjet nozzle, the inkjet nozzle comprising a nozzle chamber having a roof with a nozzle opening defined therein and a plurality of moveable paddles defining at least part of the roof, each paddle including a thermal bend actuator, the method comprising the steps of:

actuating a first thermal bend actuator via respective first drive circuitry such that a respective first paddle bends towards a floor of the nozzle chamber;

actuating a second thermal bend actuator via respective second drive circuitry such that a respective second paddle bends towards a floor of the nozzle chamber; and thereby ejecting a droplet of ink from the nozzle opening, wherein actuation of the first and second thermal bend actuators is independently controlled via the first and second drive circuitry so as to control the direction of droplet ejection from the nozzle opening.

Optionally, the first and second actuators are independently controlled by controlling at least one of:

- a timing of drive signals to each of the first and second actuators so as to provide a coordinated movement of the plurality of paddles; and
- a power of drive signals to each of the actuators so as to cause asymmetric movement of the plurality of paddles.

Optionally, either the first actuator is actuated prior to the second actuator to provide droplet ejection in a first direction, or the second actuator is actuated prior to the first actuator to provide droplet ejection in a second direction.

Optionally, either the first actuator is supplied with more power than the second actuator, or the second actuator is supplied with more power than the first actuator.

Optionally, the power of drive signals is controlled by at least one of:

a voltage of the drive signals; and a pulse width of the drive signals.

Optionally, two pairs of opposed paddles positioned relative to the nozzle opening.

Optionally, the method comprises the further steps of:

actuating a third thermal bend actuator via respective first drive circuitry such that a respective third paddle bends towards a floor of the nozzle chamber;

actuating a fourth thermal bend actuator via respective second drive circuitry such that a respective second paddle bends towards a floor of the nozzle chamber, wherein actuation of the first, second, third and fourth thermal bend actuators is independently controlled via respective first, second, third and fourth drive circuitry so as to control the direction of droplet ejection from the nozzle opening.

Optionally, the paddles are moveable relative to the nozzle opening.

Optionally, each paddle defines a segment of the nozzle opening such that the nozzle opening and the paddles are moveable relative to the floor.

In a ninth aspect, there is provided a method of compensating for a dead nozzle in a stationary pagewidth printhead, the printhead having one or more nozzle rows extending along a longitudinal axis of the printhead, each nozzle comprising a plurality of thermal bend-actuated paddles configurable to fire a droplet of ink at a plurality of predetermined different dot positions along the longitudinal axis, each nozzle having a primary dot position associated therewith, the method comprising the steps of:

identifying the dead nozzle;

selecting a functioning nozzle in a same nozzle row as the dead nozzle; and firing at least some ink droplets from the selected functioning nozzle at the primary dot position associated with the dead nozzle.

Optionally, the method further comprises the step of:

firing at least some ink droplets from the selected functioning nozzle at its own primary dot position.

Optionally, the selected functioning nozzle is positioned at a distance of one, two, three or four nozzle pitches away from the dead nozzle, wherein one nozzle pitch is defined as a minimum longitudinal distance between a pair of nozzles in the same nozzle row.

Optionally, the method further comprises the steps of:

advancing a print medium transversely past the stationary printhead by one line in a period of one line-time;

firing a first ink droplet from the selected functioning nozzle at the primary dot position associated with the dead nozzle; and firing a second ink droplet from the selected functioning nozzle at its own primary dot position, wherein the selected functioning nozzle fires the first and second ink droplets within the period of one line-time.

Optionally, the selected functioning nozzle fires the first and second ink droplets in any order.

Optionally, each nozzle is further configurable to fire a droplet of ink at a plurality of predetermined different dot positions along a transverse axis of the printhead.

Optionally, the method further comprises the steps of:

advancing a print medium transversely past the stationary printhead at a rate of one line per one line-time;

firing a first ink droplet from the selected functioning nozzle at the primary dot position associated with the dead nozzle; and firing a second ink droplet from the selected functioning nozzle at its own primary dot position, wherein the selected functioning nozzle fires the first and second ink droplets in a period of more than one line-time and less than five line-times.

Optionally, the dead nozzle is identified by detecting a resistance of one or more actuators corresponding to the dead nozzle.

In a tenth aspect, there is provided a method of printing at a dot density exceeding a nozzle density in a stationary pagewidth printhead comprised of a plurality of printhead integrated circuits butted end-on-end across the pagewidth, the printhead having at least one nozzle row extending along a longitudinal axis thereof, the method comprising the steps of:

advancing a print medium transversely past the stationary printhead at a rate of one line per one line-time;

firing droplets of ink from predetermined nozzles in the nozzle row to create successive lines of print, wherein at least some of the predetermined nozzles each fire droplets of ink at a plurality of predetermined different dot positions along the longitudinal axis during one line-time, such that the printed dot density in each line of print exceeds the nozzle density.

In an eleventh aspect, there is provided an inkjet printhead comprising:

a substrate comprising a drive circuitry layer;

a plurality of nozzle assemblies disposed on an upper surface of the substrate and arranged in one or more nozzle rows extending longitudinally along the printhead, each nozzle assembly comprising: a nozzle chamber having a floor defined by the upper surface, a roof spaced apart from the floor, and an actuator for ejecting ink from a nozzle opening defined in the roof;

a nozzle plate extending across the printhead, the nozzle plate at least partially defining the roofs; and at least one conductive track disposed on the nozzle plate, the conductive track extending longitudinally along the printhead and parallel with the nozzle rows, wherein the conductive track is connected to a common reference plane in the drive circuitry layer via a plurality of conductor posts extending between the drive circuitry layer and the conductive track.

Optionally, the common reference plane defines a ground plane or a power plane.

Optionally, the printhead comprises at least one first conductive track, wherein the first conductive track is directly connected to a plurality of actuators in at least one nozzle row adjacent the first conductive track.

Optionally, the printhead further comprises at least one second conductive track, wherein the second conductive track is not directly connected to any actuators.

Optionally, the first conductive track extends continuously along the printhead so as to provide a common reference plane for each actuator in the nozzle row.

Optionally, the first conductive track extends discontinuously along the printhead so as to provide a common reference plane for a set of actuators in the nozzle row.

Optionally, the first conductive track is positioned between a respective pair of nozzle rows, the first conductive track providing the common reference plane for a plurality of actuators in both nozzle rows of the pair.

Optionally, each actuator has a first terminal directly connected to the first conductive track and a second terminal connected to a drive transistor in the drive circuitry layer.

Optionally, each roof comprises at least one actuator and the first terminal of each actuator is connected to the first conductive track via transverse connectors extending transversely across the nozzle plate relative to the first conductive track.

Optionally, the second terminal is connected to the drive transistor via an actuator post extending between the drive circuitry layer and the second terminal.

Optionally, the actuator posts are perpendicular to a plane of the first conductive track.

Optionally, each roof includes at least one moveable paddle comprising a respective thermal bend actuator, the paddle being moveable towards the floor of a respective nozzle chamber so as to cause ejection of ink from the nozzle opening, wherein the thermal bend actuator comprises:

an upper thermoelastic beam having the first and second terminals; and a lower passive beam fused to the thermoelastic beam, such that when a current is passed through the thermoelastic beam, the thermoelastic beam expands relative to the passive beam, resulting in bending of a respective paddle towards the floor of the nozzle chamber.

Optionally, the thermoelastic beam is coplanar with the conductive track.

Optionally, the thermoelastic beam and the conductive track are comprised of a same material.

Optionally, the nozzle plate is comprised of a ceramic material.

Optionally, the drive circuitry layer comprises a drive field effect transistor (FET) for each actuator, each drive FET comprising a gate for receiving a logic fire signal, a source electrically communicating with a power plane, and a drain electrically communicating with a ground plane, the drive FET being either one of:

a pFET wherein the actuator is connected between the drain and the ground plane; or a nFET wherein the actuator is connected between the power plane and the source.

Optionally, the drive FET is a pFET and the first conductive track provides the ground plane, and further wherein the first terminal of the actuator is connected to the first conductive track and the second terminal of the actuator is connected to the drain of the pFET.

Optionally, the second conductive track provides the power plane and is connected to the source of the pFET.

Optionally, the drive FET is a nFET and the first conductive track provides the power plane, and further wherein the first terminal of the actuator is connected to the first conductive track and the second terminal of the actuator is connected to the source of the nFET.

Optionally, the second conductive track provides the ground plane and is connected to the drain of the nFET.

In a twelfth aspect, there is provided a printhead integrated circuit (IC) for an inkjet printhead, the printhead integrated circuit comprising:

a substrate comprising a drive circuitry layer;

a plurality of nozzle assemblies disposed on an upper surface of the substrate and arranged in one or more nozzle rows extending longitudinally along the printhead IC, each nozzle assembly comprising: a nozzle chamber having a floor defined by the upper surface, a roof spaced apart from the floor, and an actuator for ejecting ink from a nozzle opening defined in the roof;

a nozzle plate extending across the printhead IC, the nozzle plate at least partially defining the roofs; and at least one conductive track fused to the nozzle plate, the conductive track extending longitudinally along the printhead and parallel with the nozzle rows, wherein the conductive track is connected to a common reference plane in the drive circuitry layer via a plurality of conductor posts extending between the drive circuitry layer and the conductive track.

Optionally, the common reference plane defines a ground plane or a power plane.

Optionally, the conductive track is disposed above or below the nozzle plate.

BRIEF DESCRIPTION OF THE DRAWINGS

Optional embodiments of the present invention will now be described by way of example only with reference to the accompanying drawings, in which.

DESCRIPTION OF OPTIONAL EMBODIMENTS

Fabrication Process for Inkjet Nozzle Assembly Comprising Moveable Roof Paddle For the sake of completeness and by way of background, there will now be described a process for fabricating an inkjet nozzle assembly (or "nozzle") comprising a moveable roof paddle having a thermal bend actuator. The completed inkjet nozzle assembly 100 shown in FIGS. 15 and 16 utilizes thermal bend actuation, whereby a movable paddle 4 in a nozzle chamber roof bends towards a substrate 1 resulting in ink ejection. This fabrication process was described in the Applicant's earlier US Publication No. US 2008/0309728 and US 2008/0225077, the contents of which are herein incorporated by reference. However, it will be appreciated that corresponding fabrication processes may be used to fabricate any of the inkjet nozzle assemblies, and indeed printheads and printhead integrated circuits (ICs), described herein.

The starting point for MEMS fabrication is a standard CMOS wafer having CMOS drive circuitry disposed in upper layer(s) of a passivated silicon wafer. At the end of the MEMS fabrication process, this wafer is diced into individual printhead integrated circuits (ICs), with each IC comprising a CMOS drive circuitry layer and a plurality of nozzle assemblies.

Figure 1:
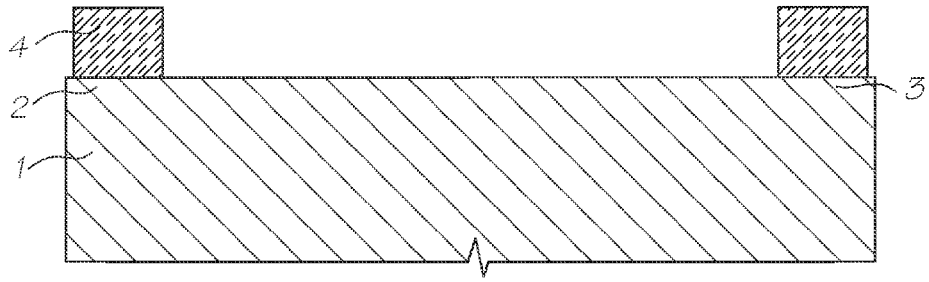
FIG. 1 is a side-sectional view of a partially-fabricated inkjet nozzle assembly after a first sequence of steps in which nozzle chamber sidewalls are formed.
Figure 2:
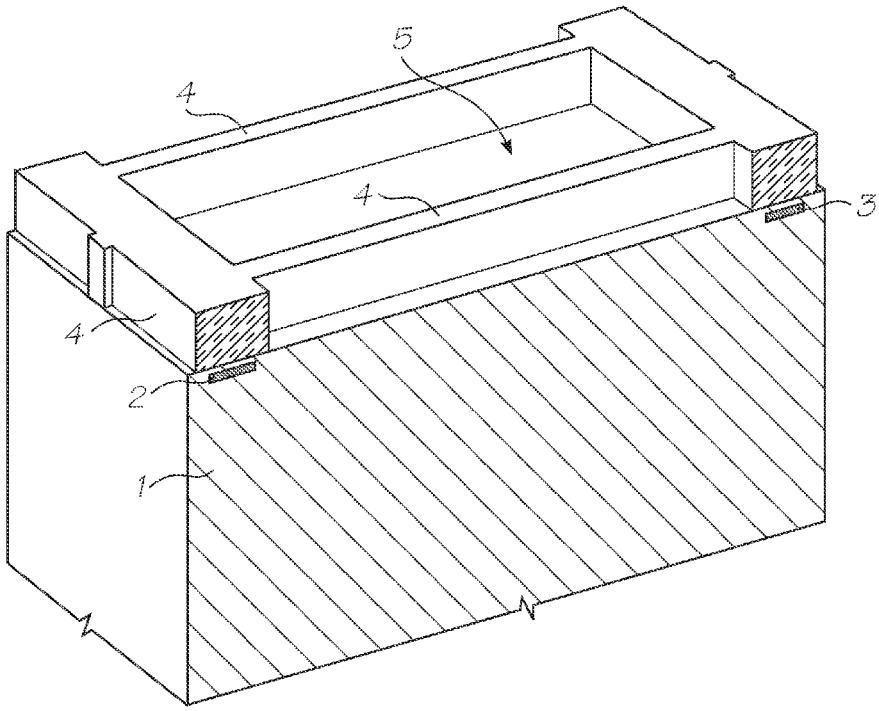
FIG. 2 is a perspective view of the partially-fabricated inkjet nozzle assembly shown in FIG. 4.

In the sequence of steps shown in FIGS. 1 and 2, an 8 micron layer of silicon dioxide is initially deposited onto an upper surface of the substrate 1. The depth of silicon dioxide defines the depth of a nozzle chamber 5 for the inkjet nozzle. After deposition of the $SiO_2$ layer, it is etched to define walls 4, which will become sidewalls of the nozzle chamber 5, shown most clearly in FIG. 2.

Figure 3:
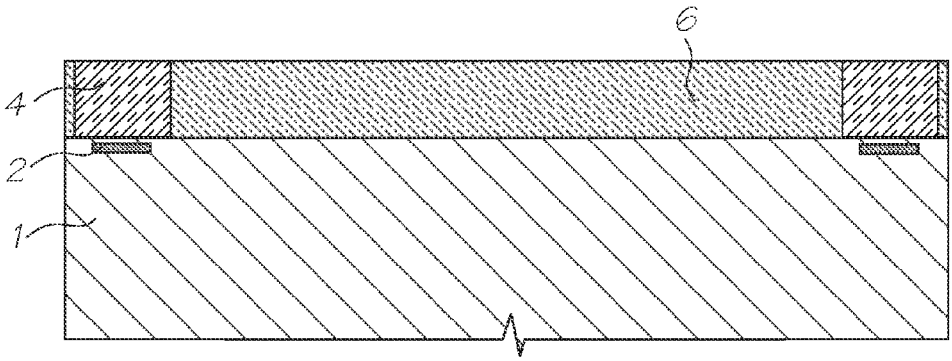
FIG. 3 is a side-sectional view of a partially-fabricated inkjet nozzle assembly after a second sequence of steps in which the nozzle chamber is filled with polyimide.
Figure 4:
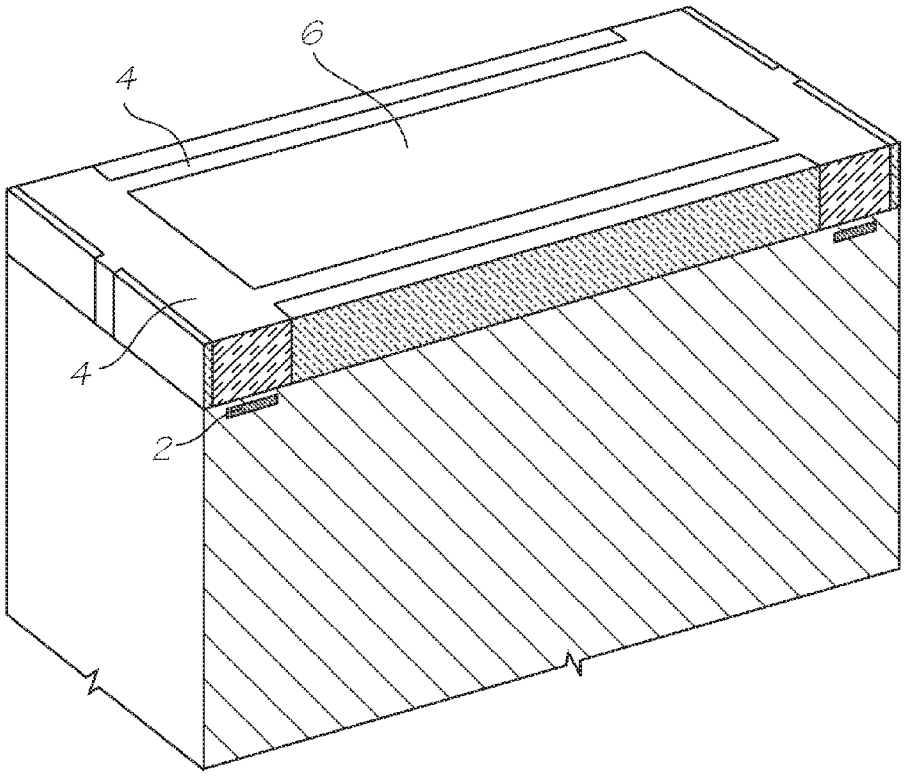
FIG. 4 is a perspective view of the partially-fabricated inkjet nozzle assembly shown in FIG. 3.

As shown in FIGS. 3 and 4, the nozzle chamber 5 is then filled with photoresist or polyimide 6, which acts as a sacrificial scaffold for subsequent deposition steps. The polyimide 6 is spun onto the wafer using standard techniques, UV cured and/or hardbaked, and then subjected to chemical mechanical planarization (CMP) stopping at the top surface of the $SiO_2$ wall 4.

Figure 5:
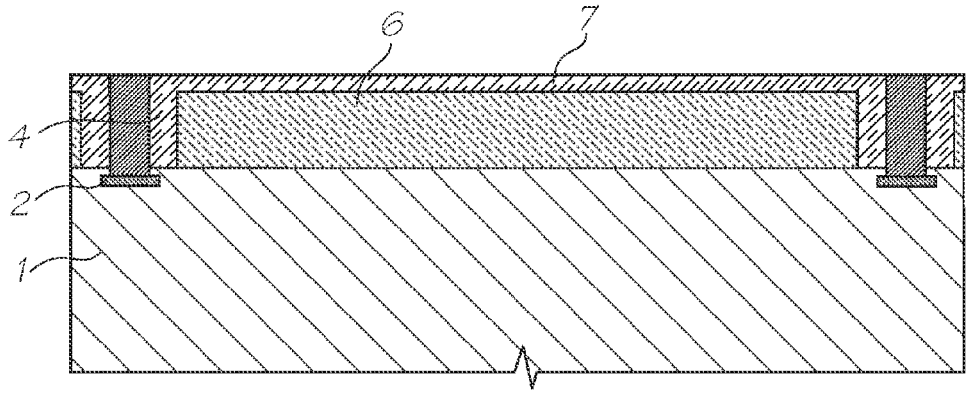
FIG. 5 is a side-sectional view of a partially-fabricated inkjet nozzle assembly after a third sequence of steps in which connector posts are formed up to a chamber roof.
Figure 6:
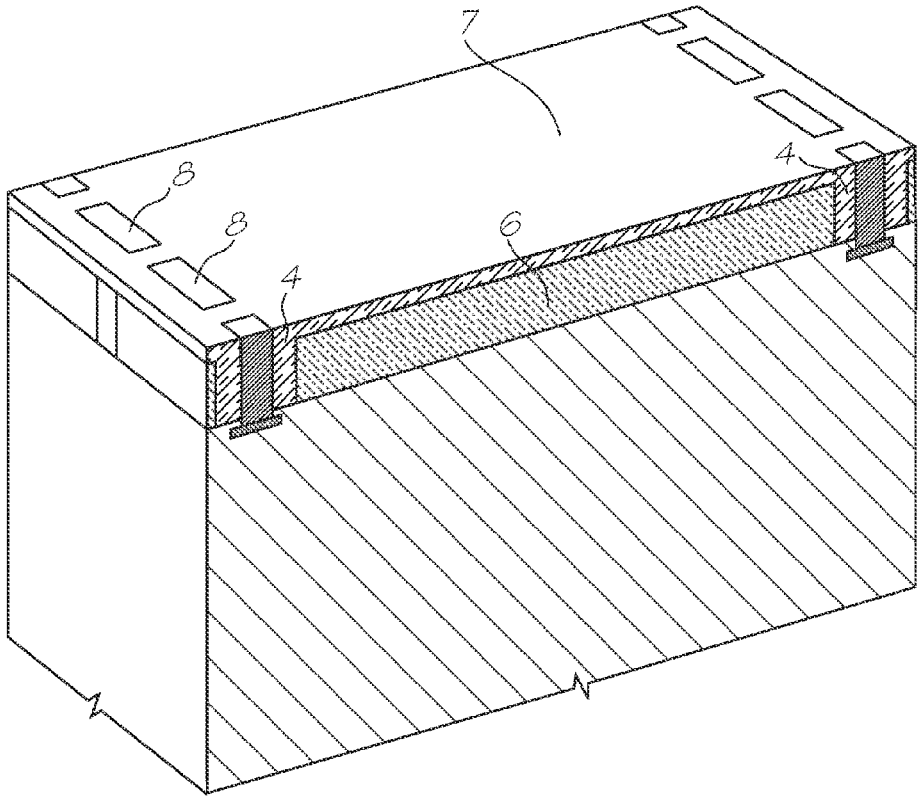
FIG. 6 is a perspective view of the partially-fabricated inkjet nozzle assembly shown in FIG. 5.

In FIGS. 5 and 6, a roof 7 of the nozzle chamber 5 is formed as well as highly conductive actuator posts 8 extending down to the electrodes 2. Initially, a 1.7 micron layer of $SiO_2$ is deposited onto the polyimide 6 and wall 4. This layer of $SiO_2$ defines the roof 7 of the nozzle chamber 5. Next, a pair of vias are formed in the wall 4 down to the electrodes 2 using a standard anisotropic DRIE. This etch exposes the pair of electrodes 2 through respective vias. Next, the vias are filled with a highly conductive metal, such as copper, using electroless plating. The deposited copper posts 8 are subjected to CMP, stopping on the $SiO_2$ roof member 7 to provide a planar structure. It can be seen that the copper actuator posts 8, formed during the electroless copper plating, meet with respective electrodes 2 to provide a linear conductive path up to the roof 7.

Figure 7:
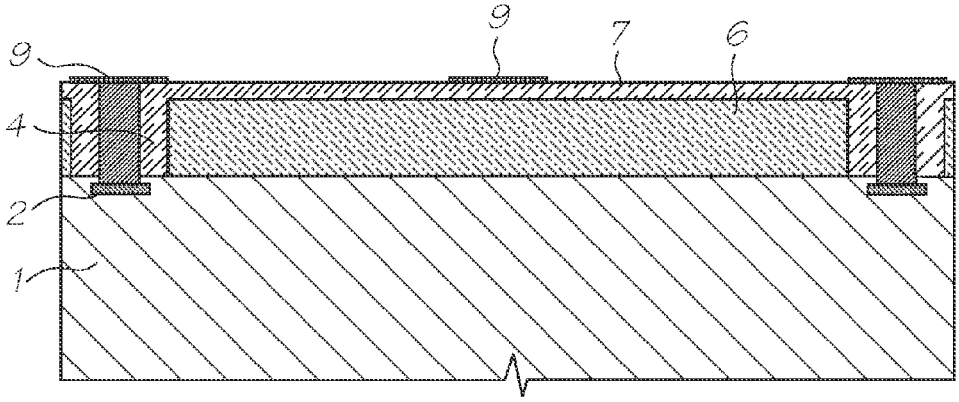
FIG. 7 is a side-sectional view of a partially-fabricated inkjet nozzle assembly after a fourth sequence of steps in which conductive metal plates are formed.
Figure 8:
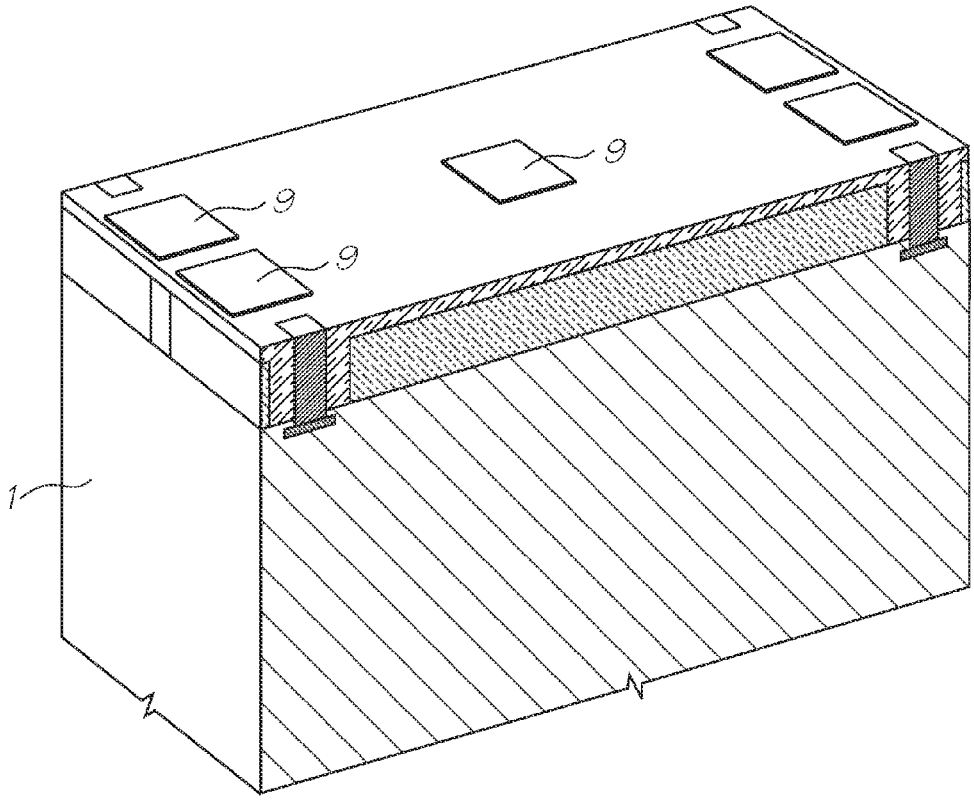
FIG. 8 is a perspective view of the partially-fabricated inkjet nozzle assembly shown in FIG. 7.

In FIGS. 7 and 8, metal pads 9 are formed by depositing and etching a 0.3 micron layer of aluminium. Any highly conductive metal (e.g. aluminium, titanium etc.) may be used and should be deposited with a thickness of about 0.5 microns or less so as not to impact too severely on the overall planarity of the nozzle assembly. The metal pads 9 are defined by the etch so as to be positioned over the actuator posts 8 and on the roof member 7 in predetermined 'bend regions' of the thermoelastic active beam member. It will of course be appreciated that the metal pads 9 are not strictly essential and that the sequence of steps shown in FIGS. 7 and 8 may be eliminate from the fabrication process.

Figure 9:
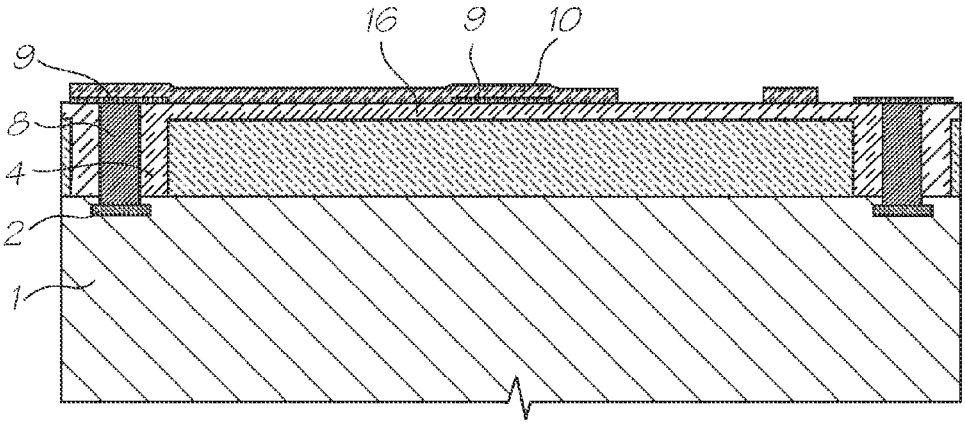
FIG. 9 is a side-sectional view of a partially-fabricated inkjet nozzle assembly after a fifth sequence of steps in which an active beam member of a thermal bend actuator is formed.
Figure 10:
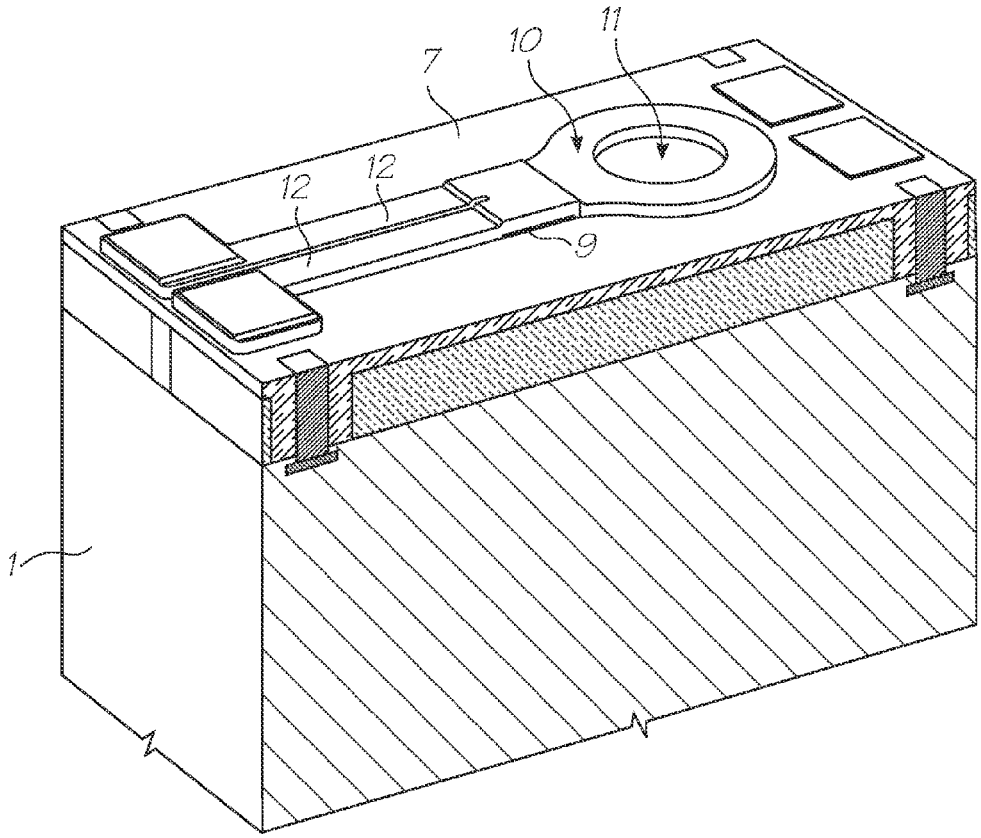
FIG. 10 is a perspective view of the partially-fabricated inkjet nozzle assembly shown in FIG. 9.

In FIGS. 9 and 10, a thermoelastic active beam member 10 is formed over the $SiO_2$ roof 7. By virtue of being fused to the active beam member 10, part of the $SiO_2$ roof 7 functions as a lower passive beam member 16 of a mechanical thermal bend actuator, which is defined by the active beam 10 and the passive beam 16. The thermoelastic active beam member 10 may be comprised of any suitable thermoelastic material, such as titanium nitride, titanium aluminium nitride and aluminium alloys. As explained in the Applicant's earlier U.S. application Ser. No. 11/607,976 filed on 4 Dec. 2002, the contents of which are herein incorporated by reference, vanadium-aluminium alloys are a preferred material, because they combine the advantageous properties of high thermal expansion, low density and high Young's modulus.

In order to form the active beam member 10, a 1.5 micron layer of active beam material is initially deposited by standard PECVD. The beam material is then etched using a standard metal etch to define the active thermoelastic beam member 10. After completion of the metal etch, and as shown in FIGS. 9 and 10, the active beam member 10 comprises a partial nozzle opening 11 and a tortuous beam element 12, which is electrically connected at each end to power and ground electrodes 2 via the actuator posts 8. The planar beam element 12 extends from a top of a first (power) actuator post and bends around 180 degrees to return to a top of a second (ground) actuator post.

Still referring to FIGS. 9 and 10, the metal pads 9 are positioned to facilitate current flow in regions of potentially higher resistance. One metal pad 9 is positioned at a bend region of the beam element 12, and is sandwiched between the active beam member 10 and the passive beam member 16. The other metal pads 9 are positioned between the top of the actuator posts 8 and the ends of the beam element 12.

Figure 11:
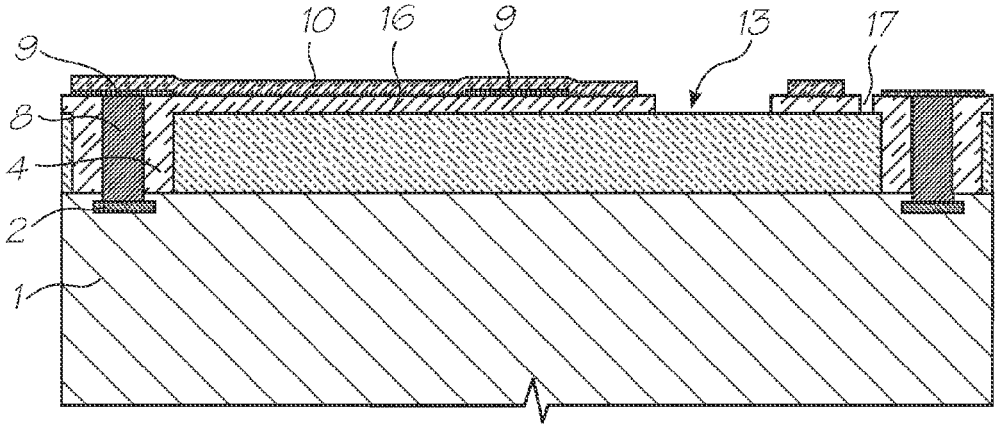
FIG. 11 is a side-sectional view of a partially-fabricated inkjet nozzle assembly after a sixth sequence of steps in which a moving roof portion comprising the thermal bend actuator is formed.
Figure 12:
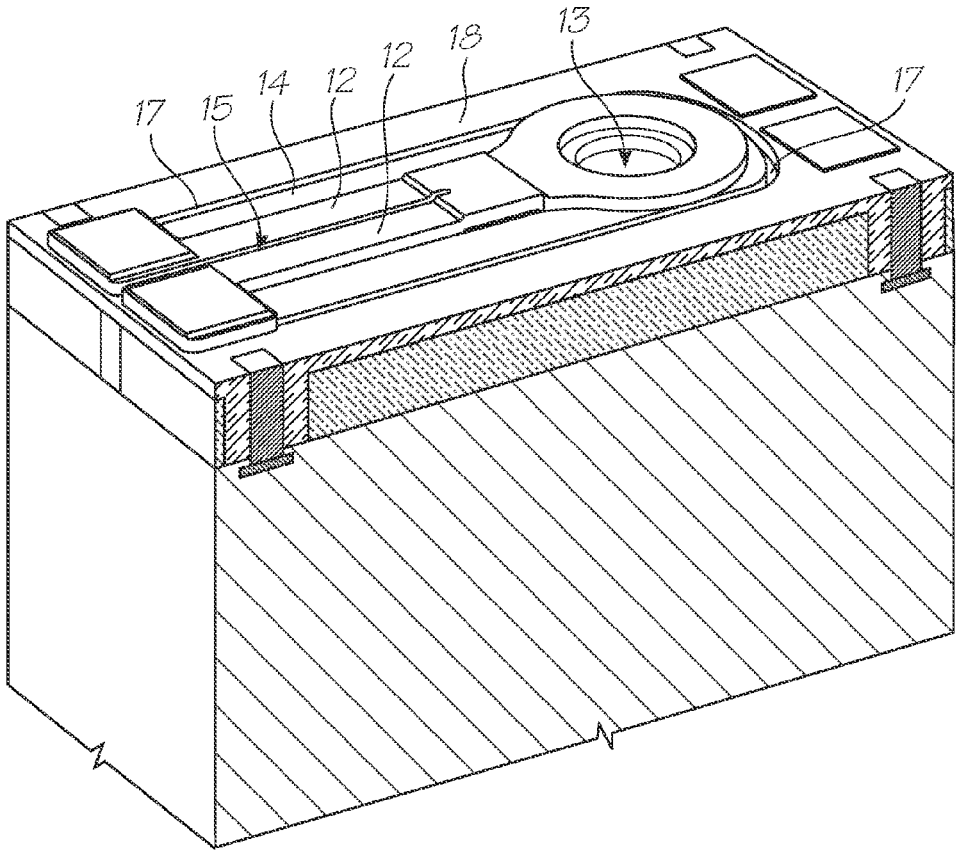
FIG. 12 is a perspective view of the partially-fabricated inkjet nozzle assembly shown in FIG. 11.

Referring to FIGS. 11 and 12, the $SiO_2$ roof 7 is then etched to define fully a nozzle opening 13 and a moveable cantilever paddle 14 in the roof The paddle 14 comprises a thermal bend actuator 15, which is itself comprised of the active thermoelastic beam member 10 and the underlying passive beam member 16. The nozzle opening 13 is defined in the paddle 14 of the roof so that the nozzle opening moves with the actuator during actuation. Configurations whereby the nozzle opening 13 is stationary with respect to the paddle 14, as described in Applicant's U.S. application Ser. No. 11/607,976 incorporated herein by reference, are equally possible.

A perimeter space or gap 17 around the moveable paddle 14 separates the paddle from a stationary portion 18 of the roof This gap 17 allows the moveable paddle 14 to bend into the nozzle chamber 5 and towards the substrate 1 upon actuation of the actuator 15.

Figure 13:
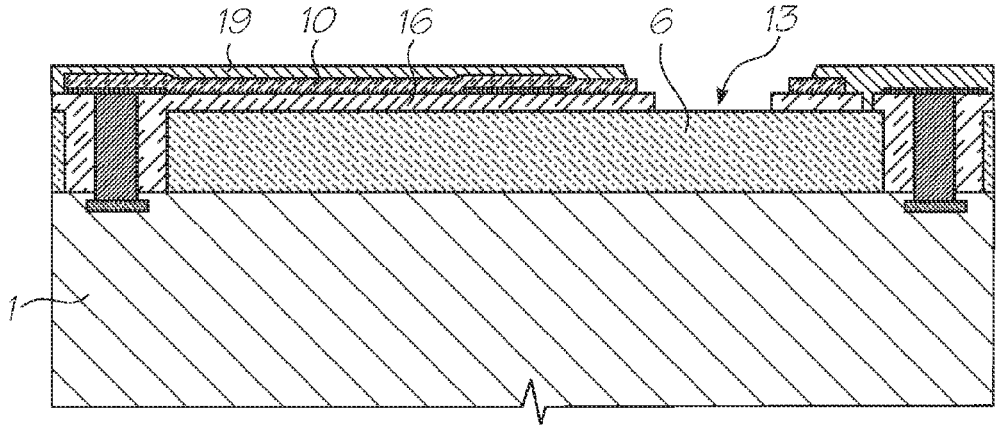
FIG. 13 is a side-sectional view of a partially-fabricated inkjet nozzle assembly after a seventh sequence of steps in which hydrophobic polymer layer is deposited and photopatterned.
Figure 14:
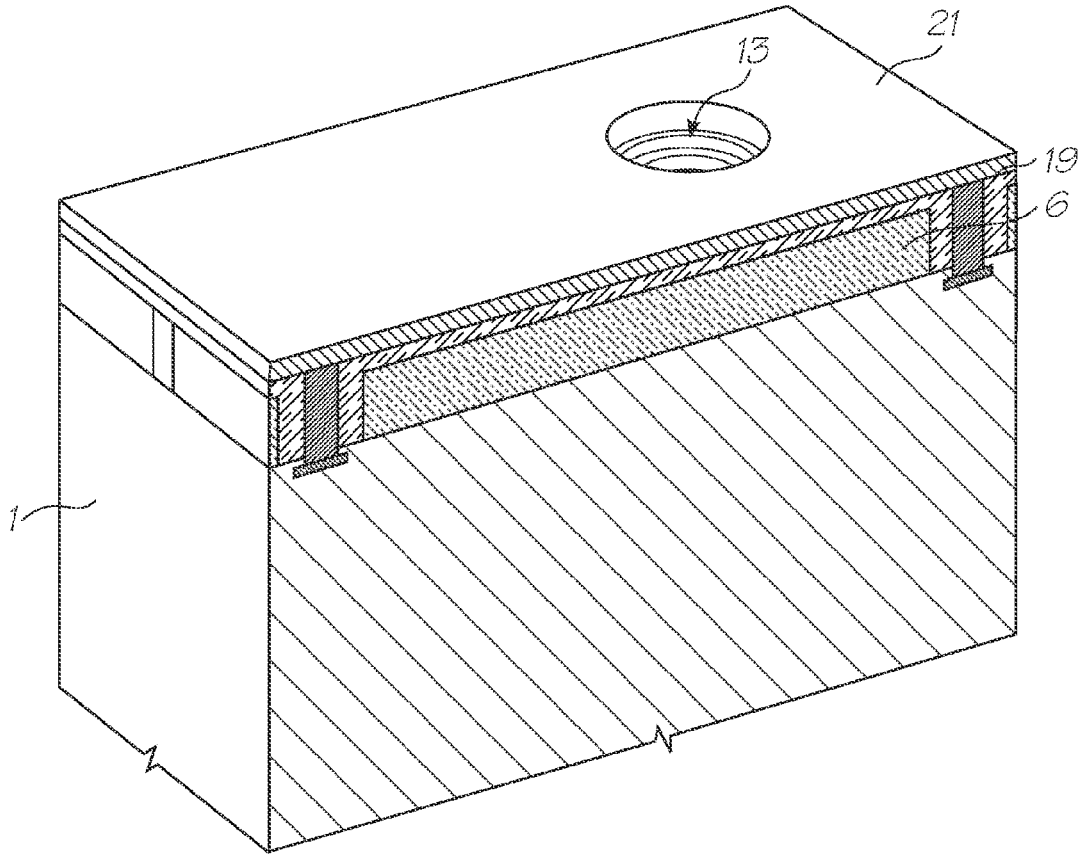
FIG. 14 is a perspective view of the partially-fabricated inkjet nozzle assembly shown in FIG. 13.

Referring to FIGS. 13 and 14, a layer of polymer 19 is then deposited over the entire nozzle assembly, and etched to re-define the nozzle opening 13. The polymer layer 19 may be protected with a thin, removable metal layer (not shown) prior to etching the nozzle opening 13, as described in US 2008/0225077, the contents of which are herein incorporated by reference.

The polymer layer 19 performs several functions. Firstly, it fills the gap 17 to provide a mechanical seal between the paddle 14 and the stationary portion 18 of the roof 7. Provided that the polymer has a sufficiently low Young's modulus, the actuator can still bend towards the substrate 1, whilst preventing ink from escaping through the gap 17 during actuation. Secondly, the polymer has a high hydrophobicity, which minimizes the propensity for ink to flood out of the relatively hydrophilic nozzle chambers and onto an ink ejection face 21 of the printhead. Thirdly, the polymer functions as a protective layer, which facilitates printhead maintenance.

The polymer layer 19 may be comprised of a polymerized siloxane, such as polydimethylsiloxane (PDMS) or any polymer from the family of polysilsesquioxanes, as described in U.S. application Ser. No. 12/508,564, the contents of which are herein incorporated by reference. Polysilsesquioxanes typically have the empirical formula $(RSiO_{1.5})_n$, where R is hydrogen or an organic group and n is an integer representing the length of the polymer chain. The organic group may be $C_{1-12}$ alkyl (e.g. methyl), $C_{1-10}$ aryl (e.g. phenyl) or $C_{1-16}$ arylalkyl (e.g. benzyl). The polymer chain may be of any length known in the art (e.g. n is from 2 to 10,000, 10 to 5000 or 50 to 1000). Specific examples of suitable polysilsesquioxanes are poly(methylsilsesquioxane) and poly(phenylsilsesquioxane).

Figure 15:
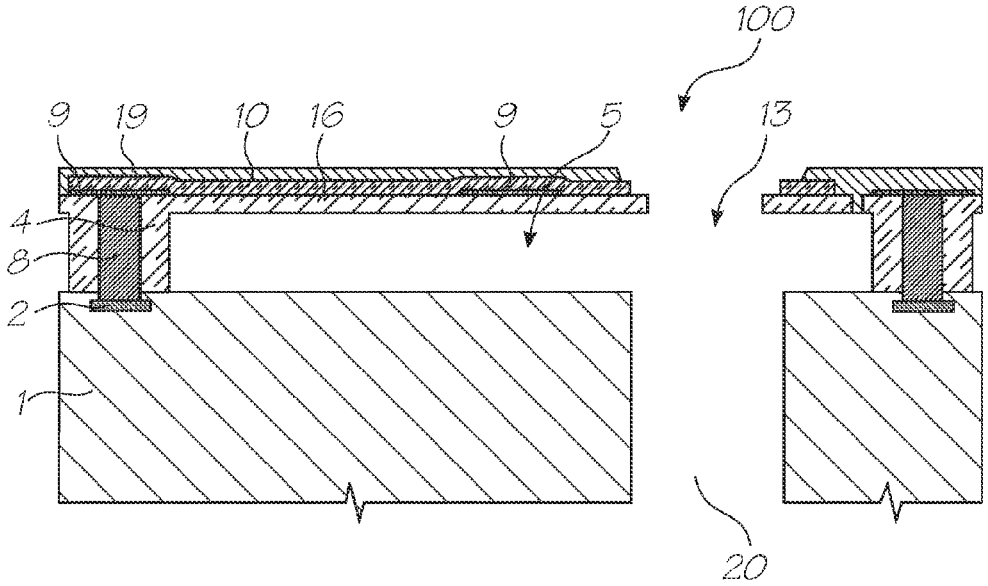
FIG. 15 is a side-sectional view of a fully formed inkjet nozzle assembly.
Figure 16:
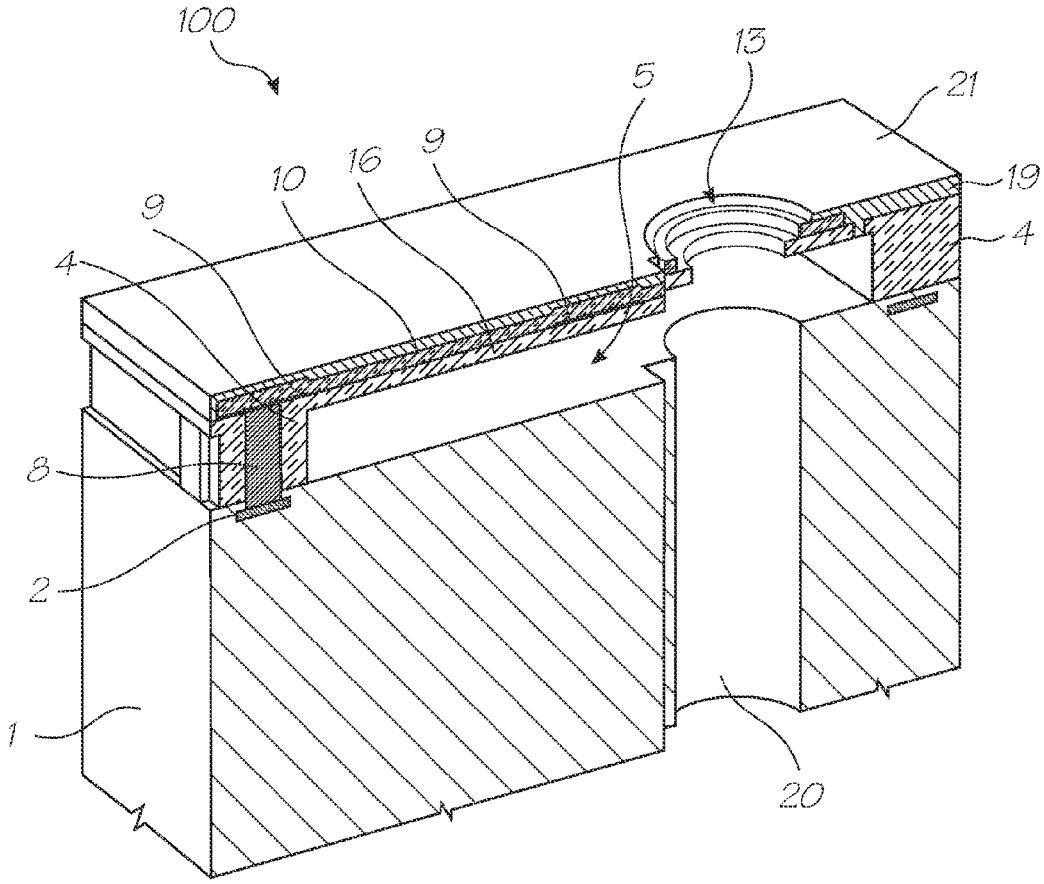
FIG. 16 is a cutaway perspective view of the inkjet nozzle assembly shown in FIG. 15.

Returning to the final fabrication steps, and as shown in FIGS. 15 and 16, an ink supply channel 20 is etched through to the nozzle chamber 5 from a backside of the substrate 1. Although the ink supply channel 20 is shown aligned with the nozzle opening 13 in FIGS. 15 and 16, it could, of course, be positioned offset from the nozzle opening.

Following the ink supply channel etch, the polyimide 6, which filled the nozzle chamber 5, is removed by ashing (either frontside ashing or backside ashing) using, for example, an $O_2$ plasma to provide the nozzle assembly 100.

Inkjet Nozzle Assembly with Opposed Pair of Moveable Roof Paddles

As best shown in FIG. 12, the inkjet nozzle assemblies described previously by the present Applicant comprise one moveable paddle 14 for ejection of ink through the nozzle opening 13.

Figure 17:
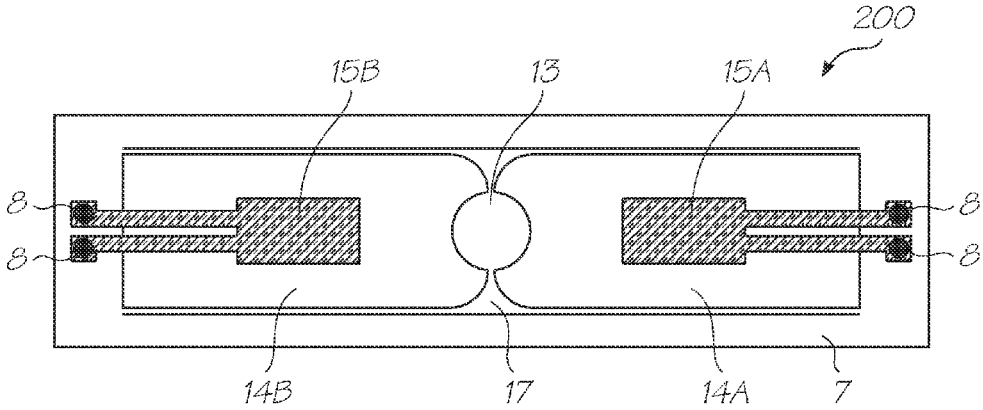
FIG. 17 is a plan view of an inkjet nozzle having opposed moveable roof paddles and a moveable nozzle opening.

Referring to FIG. 17, there is shown schematically in plan view an inkjet nozzle assembly 200 comprising a pair of opposed roof paddles 14A and 14B. The upper polymer layer 19 has been removed for clarity in all inkjet nozzles described herein which are shown in plan view. Furthermore, in the interests of clarity, features common to all inkjet nozzles assemblies described herein are given like reference numerals.

Each paddle 14A and 14B has a respective thermal bend actuator 15A and 15B defined by an upper thermoelastic beam and a lower passive beam, in the same way as the inkjet nozzle 100 described above. Moreover, each thermal bend actuator (and thereby each paddle) is independently controllable via respective drive circuitry in the CMOS drive circuitry layer of the substrate 1. This enables a first actuator 15A (and thereby a first paddle 14A) to be controlled independently of a second actuator 15B (and thereby a second paddle 14B).

FIG. 17 shows a nozzle assembly 200 having opposed paddles 14A and 14B, whereby each paddle defines a segment of the nozzle opening 13. Hence, the nozzle opening 13 will move with the paddles during actuation.

Figure 18:
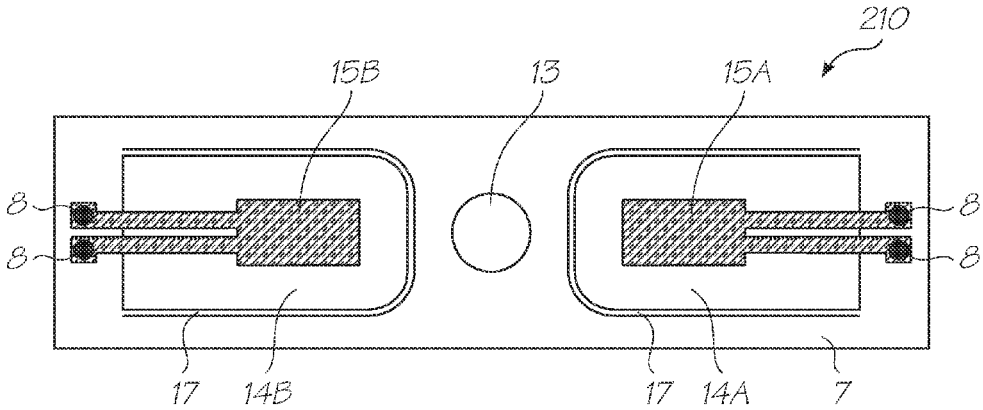
FIG. 18 is a plan view of an inkjet nozzle having opposed roof paddles moveable relative to a stationary nozzle opening.

FIG. 18 shows an alternative nozzle assembly 210 having opposed paddles 14A and 14B, whereby each paddle is moveable relative to the nozzle opening 13. In other words, the nozzle opening 13 is defined in the stationary portion of the roof 7. It will, of course, be appreciated that both nozzle assemblies 200 and 210, as shown in FIGS. 17 and 18, are within the ambit of the present invention.

Figure 19:
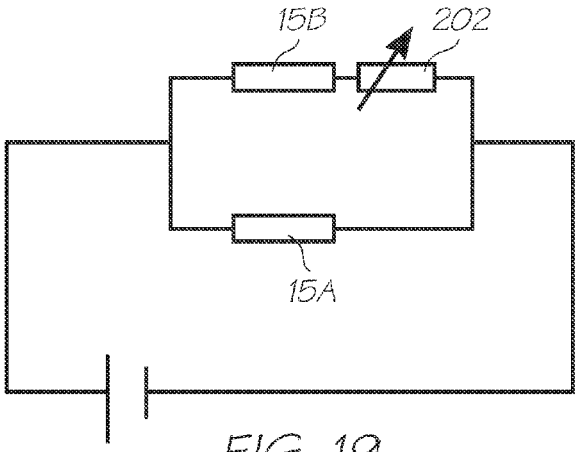
FIG. 19 is a simplified circuit diagram for independently controlling the two actuators in the inkjet nozzle shown in FIG. 17.

FIG. 19 shows a simple circuit diagram for controlling a relative amount of power supplied to each actuator 15A and 15B of the nozzle assembly 200. Actuator 15A receives full power whilst the amount of power supplied to actuator 15B is varied using the potentiometer 202.

Experimental measurements using a set of different potentiometer resistances have demonstrated that different maximum paddle velocities are achievable by reducing the amount of power supplied to actuator 15B. For example, with equal amounts of power the maximum paddle velocities are about the same. However, when the potentiometer resistance is increased, the maximum paddle velocity of paddle 14B is significantly reduced relative to paddle 14A. For example, the maximum paddle velocity of paddle 14B may be reduced to less than 75%, less than 50%, or less than 25% of the maximum paddle velocity of paddle 14A.

This difference in maximum paddle velocities, in turn, has a very significant effect on drop directionality. Thus, by controlling the relative amounts of power supplied to each actuator 15A and 15B, the direction of droplet ejection from the nozzle opening 13 can be controlled. Experimentally, droplet direction can be skewed by up to about 4 dot pitches on a printed page. Hence, dot pitches of −4, −3, −2, −1, 0, +1, +2, +3 and +4 (as well as all intervening non-integer dot positions) are achievable from one nozzle, wherein '0' is defined as the primary dot position resulting from droplet ejection perpendicular to the ink ejection face. This result has important ramifications for the design of pagewidth inkjet printheads, as will be discussed in more detail below.

Of course, for experimental purposes the use of the potentiometer 202 enables a range of power parameters to be readily investigated. However, skewed droplet ejection is also achievable by controlling the timing of actuation, either as an alternative to or in addition to controlling the power supplied to each actuator. For example, actuator 15A may receive its actuation signal either before or after actuator 15B receives its actuation signal, resulting in asymmetric paddle movement and skewed droplet ejection.

Moreover, the power supplied to each actuator may be controlled by varying a pulse width of drive signals. Indeed, this method of varying the power supplied to each actuator may be the most feasible using CMOS drive circuitry, especially in cases where it is desirable to change droplet direction 'on-the-fly'.

Inkjet Nozzle Assembly With Four Moveable Roof Paddles

The nozzle assemblies 200 and 210, shown in FIGS. 17 and 18, enable a direction of droplet ejection to be controlled along one axis. Typically (and most usefully), this axis will be the longitudinal axis of an elongate pagewidth printhead along which nozzle rows extend. However, further control of droplet directionality is achievable through the use of more than two paddles arranged relative to the nozzle opening.

Figure 20:
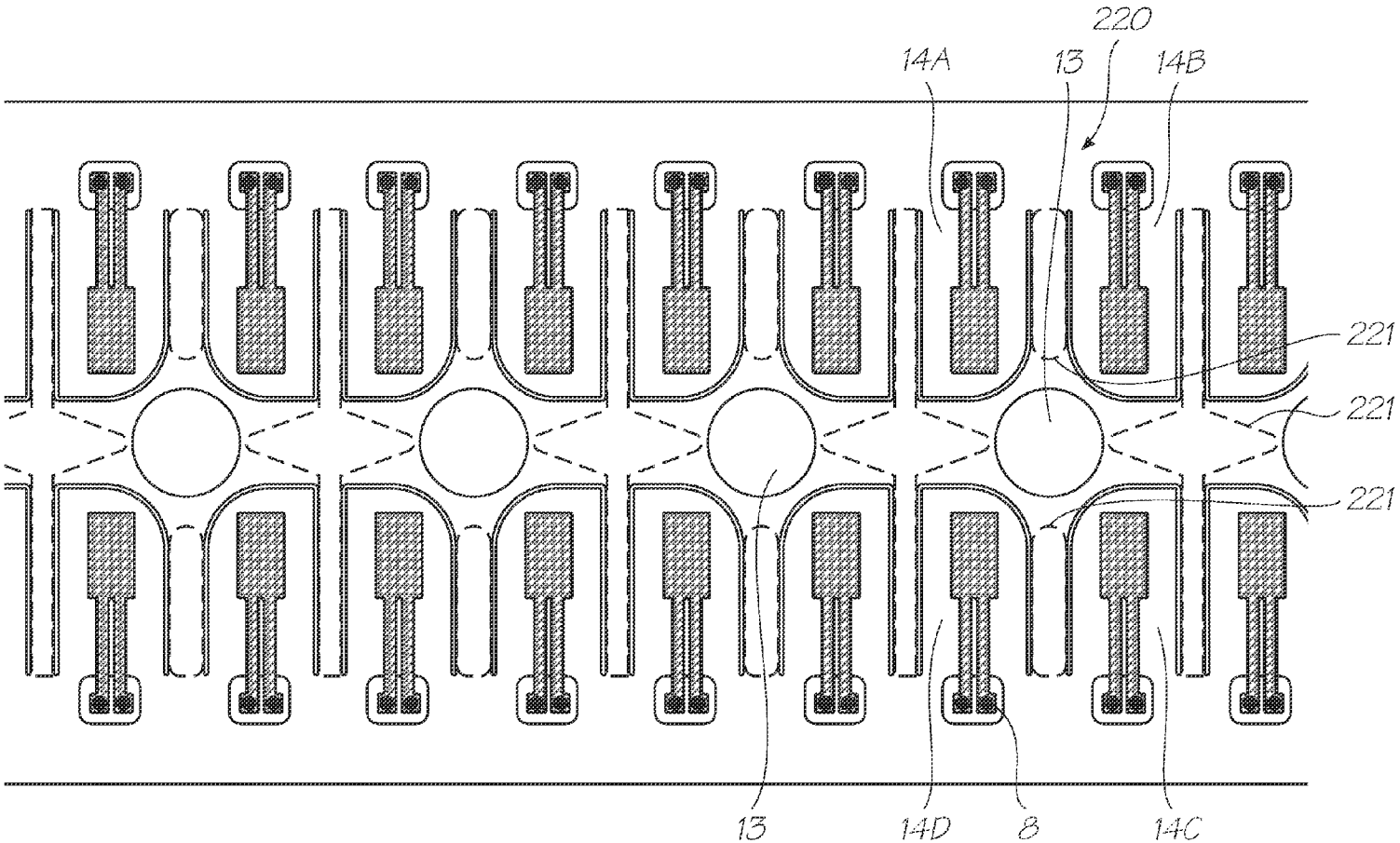
FIG. 20 is a plan view of part of a printhead comprising inkjet nozzles with four moveable roof paddles.

FIG. 20 shows part of a printhead comprising inkjet nozzle assemblies 220, each nozzle assembly 220 comprising four moveable paddles 14A, 14B, 14C and 14D arranged relative to the stationary nozzle opening 13. Damping pillars 221 projecting from sidewalls of the nozzle chamber assist in controlling drop ejection characteristics and chamber refilling, especially in cases where one of the actuators fails.

In the four-paddle arrangement shown in FIG. 20, droplet ejection may be skewed along either or both axes (i.e. longitudinal and transverse axes) through coordinated movement of the four paddles. Hence, an ink droplet may be ejected anywhere onto a two-dimensional zone of a print medium, which is typically a circular or elliptical zone having the firing nozzle at its centroid.

Figure 21:
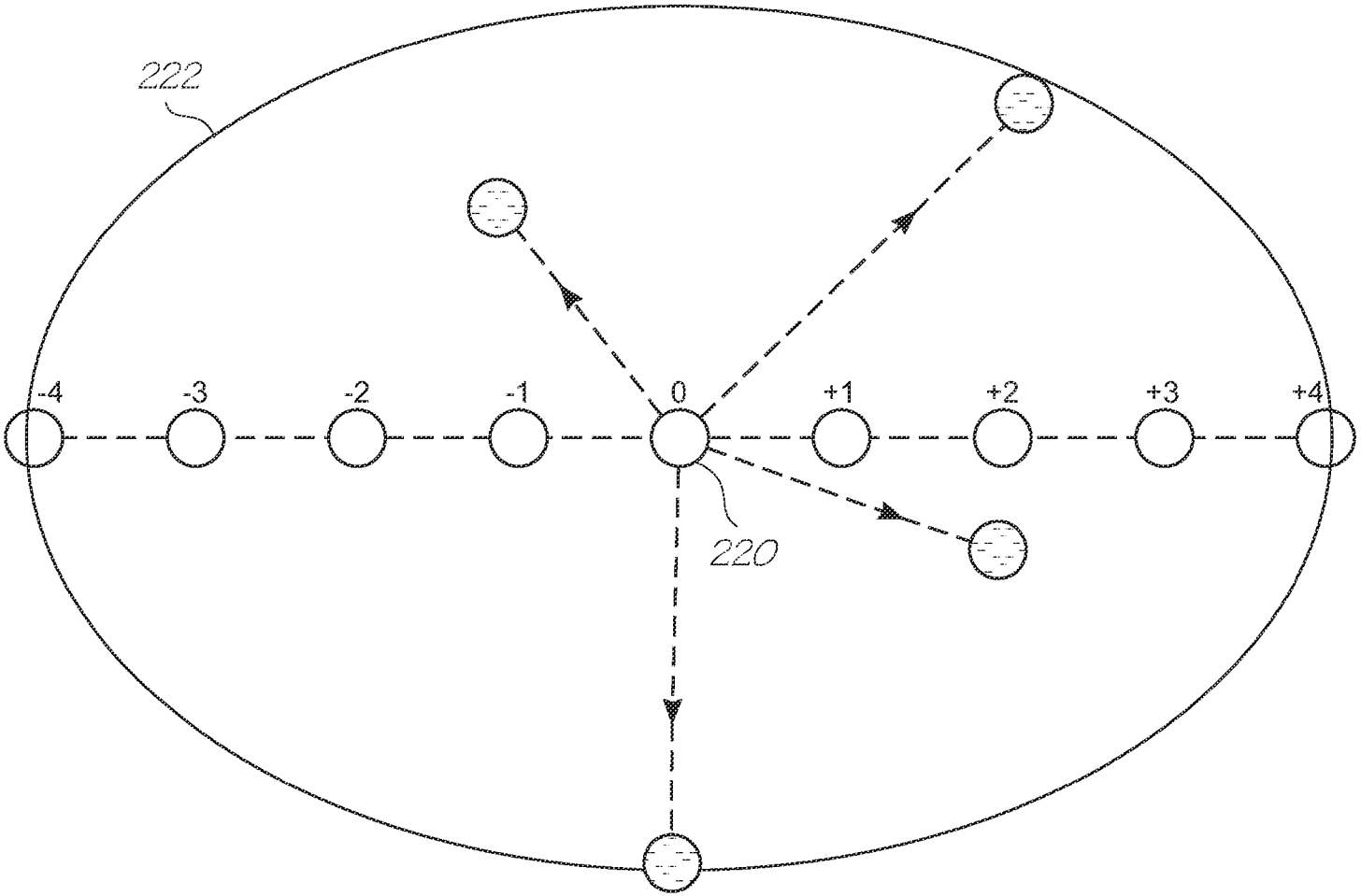
FIG. 21 shows a two-dimensional printable zone for one of the inkjet nozzles shown in FIG. 20.

FIG. 21 shows part of a nozzle row having a plurality of nozzles 220 spaced apart from each other by a distance of one nozzle pitch along a longitudinal axis of the nozzle row. An elliptical zone 222 of a print medium shows the area onto which a firing nozzle ('0'), positioned at the centroid of the elliptical zone, can fire ink droplets. As seen in FIG. 21, the firing nozzle ('0') can fire at any dot position within the two-dimensional elliptical zone 222.

The ability to fire ink droplets along a transverse axis (i.e. perpendicular to longitudinal nozzle row axis) means that droplet ejection from the nozzle assembly 220 need not occur in strict synchrony with other nozzles in the same nozzle row. Typically, all firing nozzles in a pagewidth printhead must fire within a period of one line-time, which is the time taken for a print medium to advance transversely past the printhead by a distance of one line. However, a firing nozzle with the ability to eject ink droplets along a transverse axis of the printhead can be configured to fire an ink droplet either before or after a line of printing has passed by the nozzle and still direct the ink droplet at this same line of printing. Accordingly, the nozzle assembly 220 enables pagewidth printhead design with even greater flexibility than the nozzle assemblies 200 and 210.

In addition, multiple roof paddles increase the overall ejection power available to each nozzle. Therefore a four-paddle nozzle design is more suitable for ejection of viscous fluids than a two-paddle or a one-paddle design. Similarly, a two-paddle nozzle design is more powerful than a one-paddle design.

The power of each individual actuator may also be increased by increasing the length of the actuator beam and/or providing a serpentine actuator beam with a plurality of turns. Serpentine actuator beams are described in the Applicant's U.S. Pat. No. 7,611,225, the contents of which are herein incorporated by reference. Thus, the present invention also provides high-powered inkjet nozzles suitable for the ejection of fluids having a relatively high viscosity e.g. a higher viscosity than water.

Inkjet Printhead With High Dot Density

In a typical pagewidth printhead, each firing nozzle (that is, a nozzle selected for firing by print data received by the printhead) fires once within one line-time. Moreover, each nozzle ejects an ink droplet such that it lands at a primary dot position associated with the nozzle. When a nozzle ejects onto its associated primary dot position, droplet ejection is usually perpendicular to the ink ejection face of the printhead. Thus, in traditional pagewidth printheads, the nozzle density of the printhead corresponds with the dot density of the printed page. For example, a pagewidth nozzle row having a nozzle pitch of n, will print a line of dots having a dot pitch of n, where the nozzle pitch and the dot pitch are defined as the distance between a centroid of adjacent nozzles and dots, respectively.

However, the inkjet nozzle assemblies 200, 210 and 220 enable printheads to be designed whereby the printed dot pitch is less than the nozzle pitch of the printhead, and therefore the printed dot density exceeds the nozzle density of the printhead.

Figure 22:
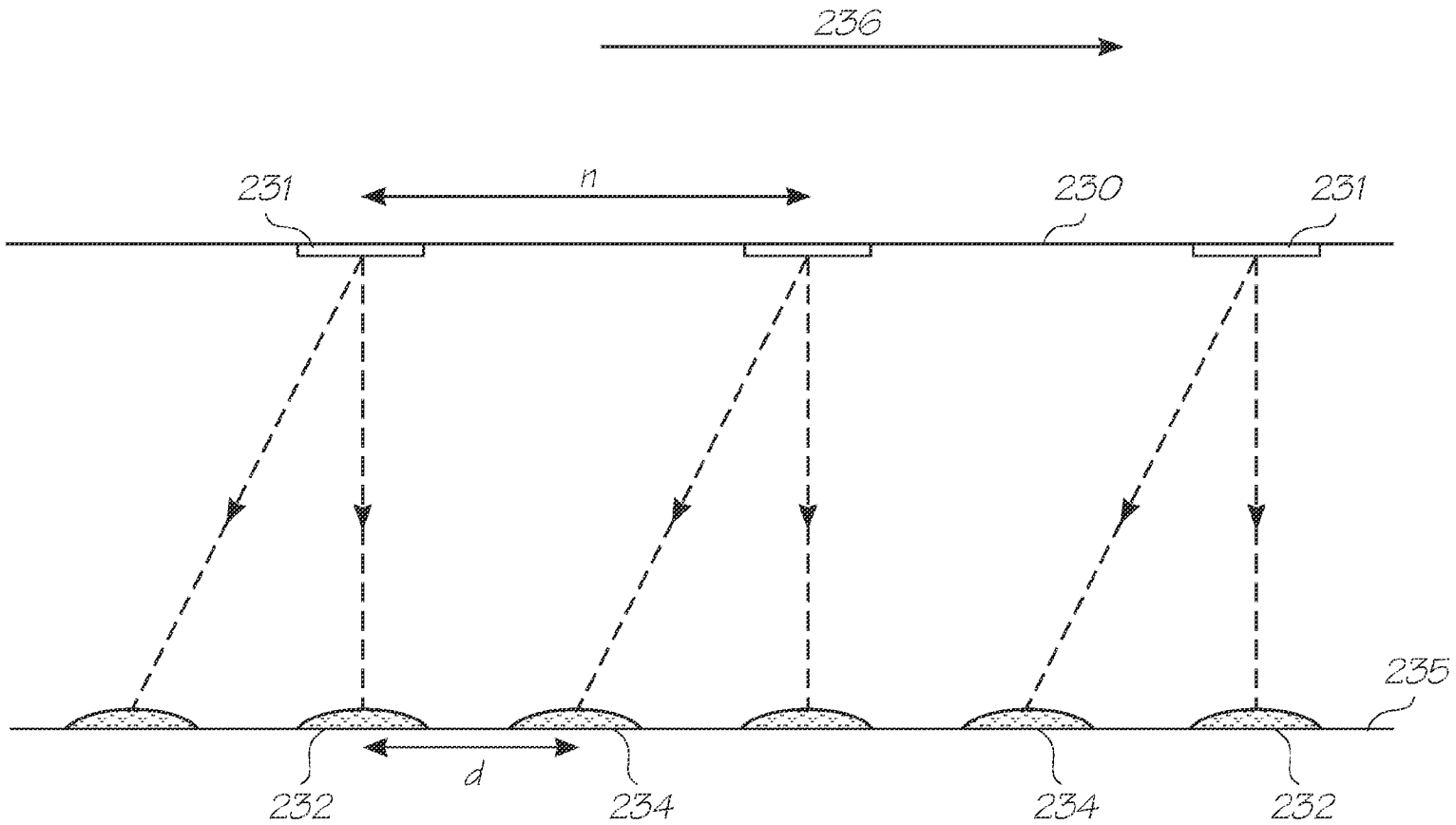
FIG. 22 is a side view of part of an inkjet printhead configured such that a printed dot density is higher than a nozzle density of the printhead.

FIG. 22 shows part of a pagewidth printhead 230 where the printed dot pitch is less than the nozzle pitch of the printhead. Three nozzles 231 in a same nozzle row are shown, spaced apart by a nozzle pitch n. Each of these nozzles may be comprised of, for example, the nozzle assembly 210 (as shown in FIG. 18). An ink droplet from each nozzle is ejectable onto a print medium 235 at a plurality of different dot positions along a longitudinal axis denoted by arrow 236. As shown in FIGS. 22, 23, 29 and 30, the print medium 235 is being fed out of the page (i.e. towards the viewer and transversely with respect to the longitudinal axis of the printhead or printhead IC).

Still referring to FIG. 22, each nozzle 231 is configured to eject ink at two different dot positions with a period of one line-time—one dot position is the primary dot position 232 resulting from droplet ejection normal to the printhead face; the other dot position 234 results from skewed ink ejection which lands ink droplets midway between the primary dot positions. The resultant dot pitch d is therefore less than the nozzle pitch n so that the printed dot density exceeds the nozzle density of the printhead.

In the example shown in FIG. 22, the nozzle pitch n is twice the dot pitch d, although it will be appreciated that any ratio of nozzle pitch n and dot pitch d may be configurable by the printhead such that n>d. For example, printing at a dot pitch whereby n=3d would be achieved if each nozzle prints at its primary dot position and two other dot positions (e.g. on either side of the primary dot position) within one line-time.

The actual dot pitch achievable is only limited by ink chamber refill rates relative to the rate at which print media are fed past the printhead. The Applicant's modeling has shown that at 60 pages per minute, ink chambers may be refilled at least twice within one line-time so as to allow printing at twice the dot density usually achieved by a typical stationary pagewidth printhead. Of course, slowing the rate of print media feed (e.g. to 30 ppm) would allow even higher dot densities.

In this way, stationary pagewidth printheads may achieve similar versatility to scanning printheads. In scanning printheads, it is well known that the printed dot density may by increased by printing at slower speeds, because the scanning printhead scans across each line and has an opportunity to print at many different dot positions depending on the scan speed. The stationary pagewidth printhead 230 shown in FIG. 22 has similar versatility and enables printing at very high dot densities (e.g. 3200 dpi), albeit at much faster printing speeds than traditional scanning printheads.

Dead Nozzle Compensation

The Applicant has previously described mechanisms for dead nozzle compensation in stationary pagewidth printheads. As used herein, a 'dead nozzle' means a nozzle which is not ejecting any ink, or a nozzle which is ejecting ink with insufficient control of drop velocity or drop directionality. Usually 'dead nozzles' are caused by actuator failure (which is the most readily identifiable cause of nozzle failure via detection circuitry), but may also be caused by a non-removable blockage in the nozzle opening or non-removable debris on the ink ejection face which obscures or partially obscures the nozzle opening.

Typically, dead nozzle compensation in stationary pagewidth printheads requires printing from redundant nozzle rows (as described in U.S. Pat. Nos. 7,465,017 and 7,252,353, the contents of which are herein incorporated by reference). This has the disadvantage that the printhead requires redundant nozzle row(s), which inevitably increases printhead cost.

Alternatively, the visual effect of a dead nozzle may be compensated by firing (preferably 'overpowering') a nozzle adjacent the dead nozzle (as described in U.S. Pat. No. 6,575,549, the contents of which are herein incorporated by reference). In effect, this involves modification of the print mask so that the overall visual effect of the dead nozzle is minimized.

Figure 23:
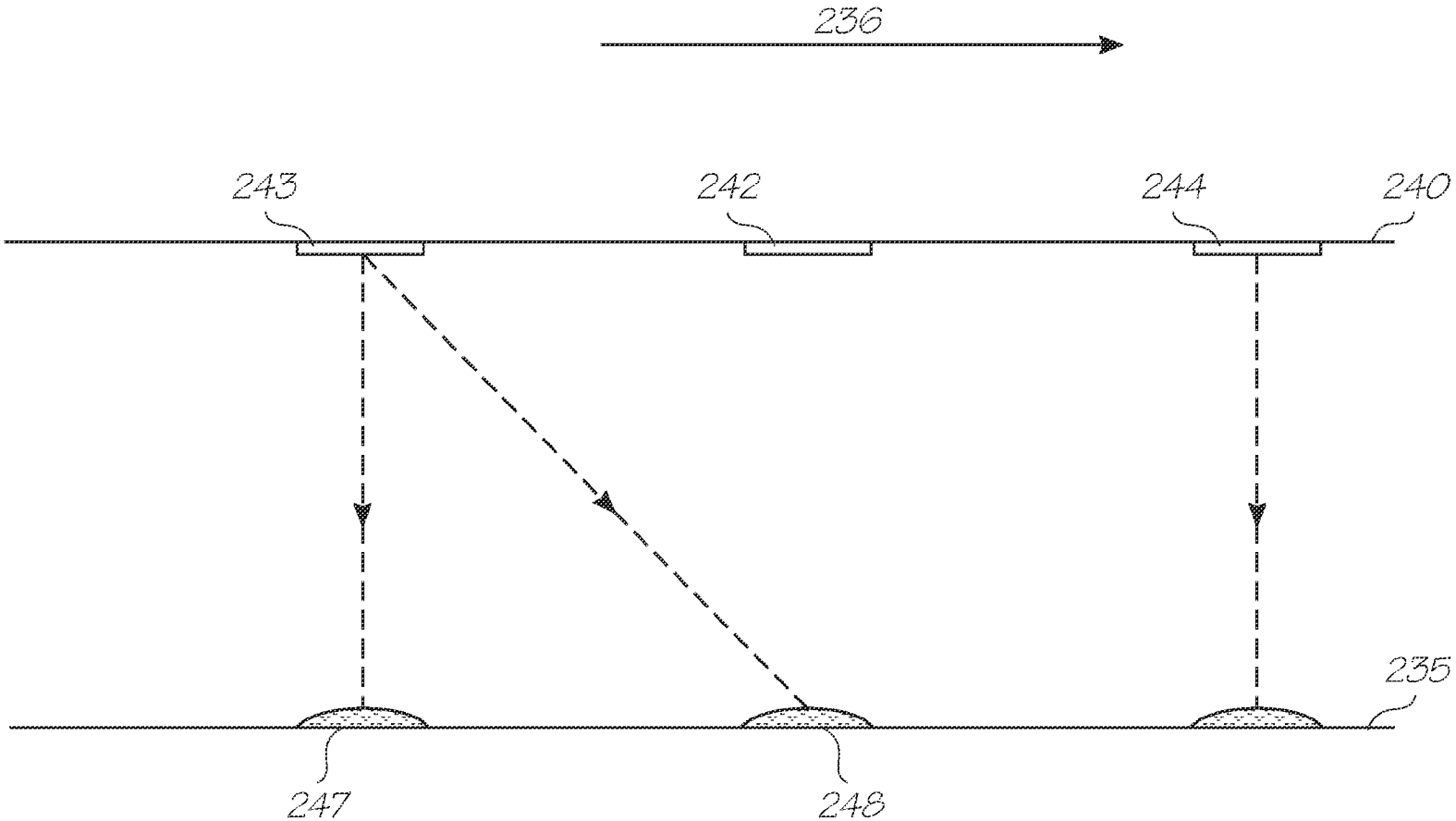
FIG. 23 is a side view of part of an inkjet printhead configured for dead nozzle compensation.

The inkjet nozzle assemblies 200, 210 and 220 enable dead nozzle compensation without requiring redundant nozzle rows or changing the print mask. FIG. 23 shows part of a pagewidth printhead 240 where a dead nozzle 242 is compensated by an adjacent functioning nozzle 243 in the same nozzle row.

Three nozzles in a same nozzle row are shown, each of which is comprised of the nozzle assembly 210 (as shown in FIG. 18). The central nozzle 242 is dead or otherwise malfunctioning, whilst the adjacent nozzles 243 and 244 on either side of the central nozzle 242 are functioning normally.

An ink droplet from each functioning nozzle 243 and 244 is ejectable onto the print medium 235 (fed towards the viewer as viewed in FIG. 23) at a plurality of different dot positions along the longitudinal axis 236. The nozzle 243 ejects an ink droplet at its own primary dot position 247 and at a primary dot position 248 associated with the dead nozzle 242 within a period of one line-time. Thus, the nozzle 243 compensates for the dead nozzle 242, which is in the same nozzle row, by printing two dots within a period of one line-time. Of course, in a subsequent line-time, the nozzle 244 may compensate for the dead nozzle 242 instead of nozzle 243, so that nozzles 243 and 244 together share the workload of compensating for the dead nozzle. Moreover, the compensatory nozzle(s) need not be immediately adjacent the dead nozzle, depending on the degree of skewed droplet ejection achievable. For example, the compensatory nozzle(s) may be positioned at −4, −3, −2, −1, +1, +2, +3 or +4 nozzle pitches away from the dead nozzle, enabling many different nozzles to share the workload of compensating for a dead nozzle.

FIG. 23 shows the scenario where nozzle 243 is required to fire a droplet of ink at its own primary dot position 247 and at the primary dot position 248 associated with the dead nozzle 242 within one line-time. Of course, the print mask primarily dictates which nozzles are required to fire during one line-time. In the event that a dead nozzle is required by the print mask to fire in a particular line-time, then a suitable functioning nozzle may be prioritized for compensation if it is not required to fire at its own primary dot position during that particular line-time. Selection of compensatory nozzles in this way further minimizes the demands on functioning nozzles neighboring a dead nozzle. Indeed, in many instances and depending on the print mask, it may be possible to avoid a compensatory nozzle being required to fire twice within one line-time.

Alternatively, a printhead comprised of nozzle assemblies 220 enables dead nozzle compensation without necessarily firing compensatory nozzles within the same line-time allocated to the dead nozzle. Since the nozzle assembly 220 can fire onto any dot position with a two-dimensional zone (including dot positions along a transverse axis of the printhead), then compensation for the dead nozzle can either be delayed to a later line-time or brought forward to an earlier line-time. This allows even greater versatility in the selection and timing of compensatory nozzles.

Dead nozzles are typically identified by detecting a resistance of one or more actuators corresponding to the dead nozzle. This method advantageously enables dynamic dead nozzle identification and compensation. However, other methods for identifying dead nozzles (e.g. optical techniques using predetermined printed patterns) are, of course, possible.

Pagewidth Printhead with Seamless Joins

With the exception of monolithic pagewidth printheads which suffer from very low wafer yields, the Applicant's pagewidth printheads are generally constructed by butting together a plurality of printhead ICs end-on-end across a pagewidth.

Figure 24:
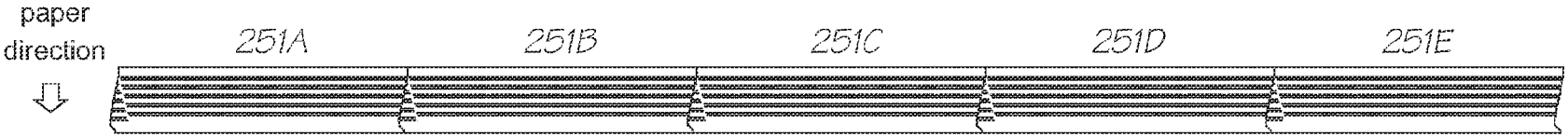
FIG. 24 is a plan view of an inkjet printhead comprised of five butting printhead ICs.
Figure 25:
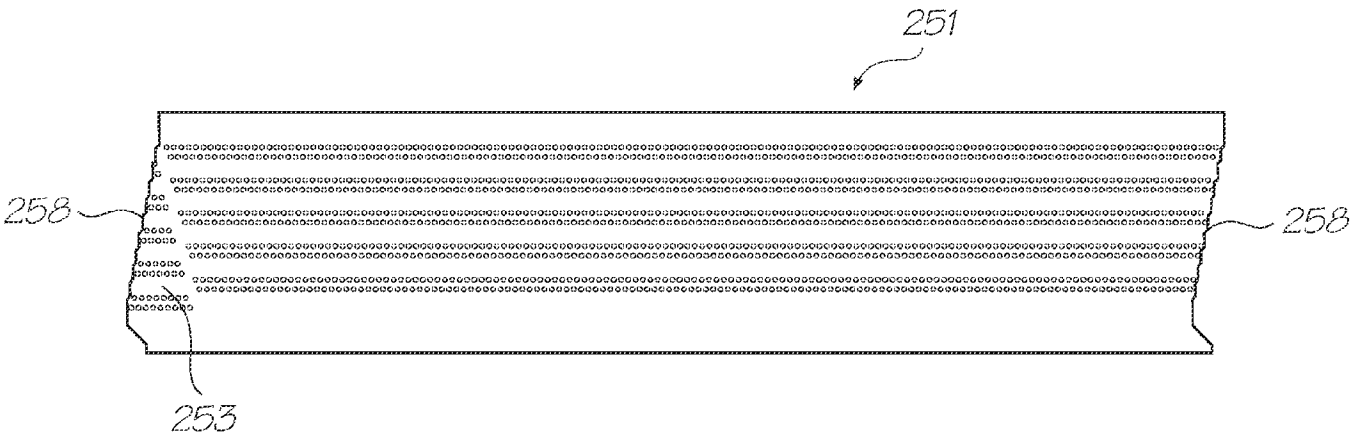
FIG. 25 is a plan view of an individual printhead IC.
Figure 26:
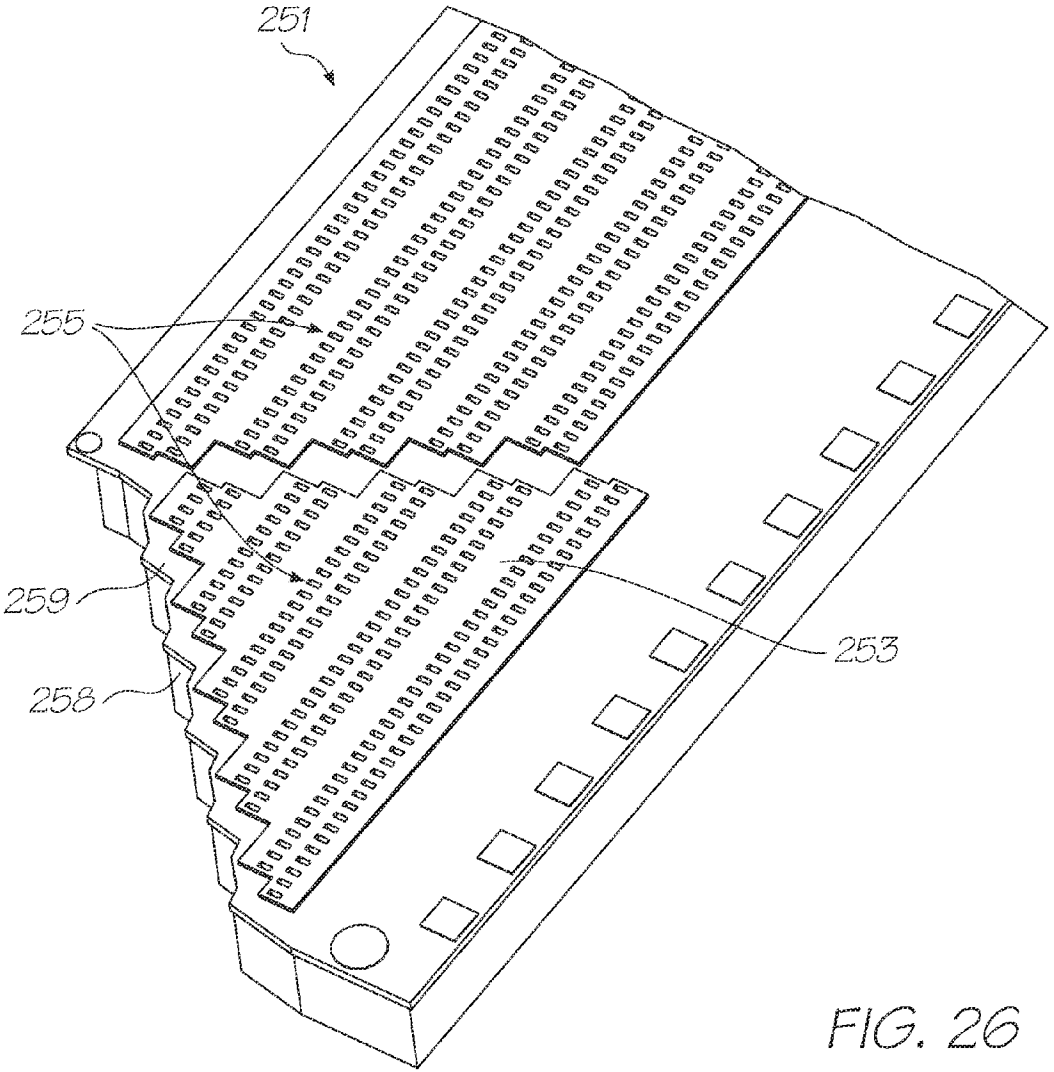
FIG. 26 is a perspective view of an end region of the printhead IC shown in FIG. 25.

FIG. 24 shows an arrangement of five printhead ICs 251A-E butted end-on-end to form a photowidth printhead 250, while a single printhead IC 251 is shown in FIG. 25. It will be appreciated that longer pagewidth printheads (e.g. A4 printheads and wide-format printheads) may be fabricated by butting more printhead ICs 251 together. Butting printhead ICs together in this way has the advantage of minimizing a width of the print zone, which in turn obviates the requirement for very precise alignment between the print media and the printhead. However, and referring to FIGS. 26 and 27, printhead ICs butting together have a disadvantage that it is difficult to print across join regions 257 between butting printhead IC pairs. This is because nozzles 255 cannot be fabricated up to the very edges 258 of each printhead IC—an inevitable amount of 'dead space' 259 must be maintained at the edges for structural robustness and for allowing printheads ICs to be butted together. Hence, the actual nozzle pitch between butting ICs is inevitably larger than one nozzle pitch within a nozzle row of a printhead IC.

Figure 27:
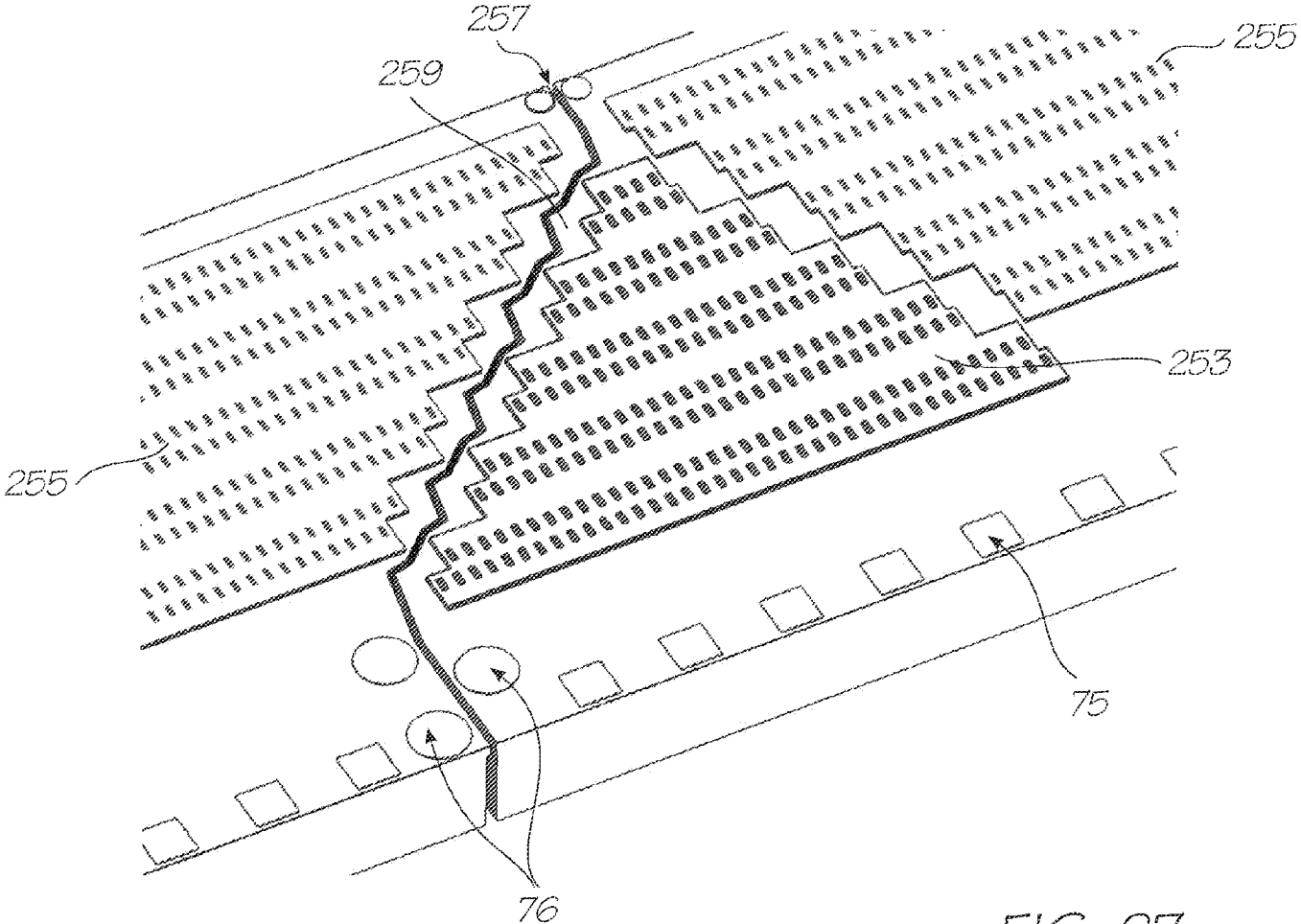
FIG. 27 is a perspective view of a join region between a pair of printhead ICs as shown in FIG. 25.

Consequently, pagewidth printheads must be designed to print dots seamlessly across join regions. Referring again to FIGS. 24 to 27, the Applicant has hitherto described a solution to the problem of constructing pagewidth printheads from abutting printhead ICs. As best shown in FIG. 27, a displaced triangle of nozzles 253 effectively fills the gap between nozzles from adjacent butting printhead ICs. By adjusting the timing of nozzles 255 fired within the displaced triangle 253 (i.e. by firing these nozzles later than their corresponding nozzle row), dots can be printed seamlessly across the join region 257. The function of the displaced nozzle triangle 253 is described extensively in U.S. Pat. Nos. 7,390,071 and 7,290,852, the contents of which are herein incorporated by reference.

FIG. 27 also shows bond pads 75 positioned along one longitudinal edge of the printhead IC and alignment fiducials 76. The bond pads 75 are connected via wirebonds (not shown) to provide power and logic signals to the CMOS drive circuitry in the printhead IC. The alignment fiducials 76 allow butting printhead ICs to be aligned with each other during construction of the printhead using a suitable optical alignment tool (not shown).

Although the displaced nozzle triangle 253 provides an adequate solution to the problem of printing across join regions, several problems still remain. Firstly, the displaced nozzle triangle 253 must be supplied with ink, and a sharp kink in longitudinally-extending backside ink supply channels can adversely affect the supply of ink to nozzles within the triangle 253. Secondly, the displaced nozzle triangle 253 reduces wafer yields because it increases the width of each printhead IC 251; effectively, each printhead IC must have a width sufficient to accommodate r+2 nozzle rows, even though the printhead IC only has r nozzle rows.

Figure 28:
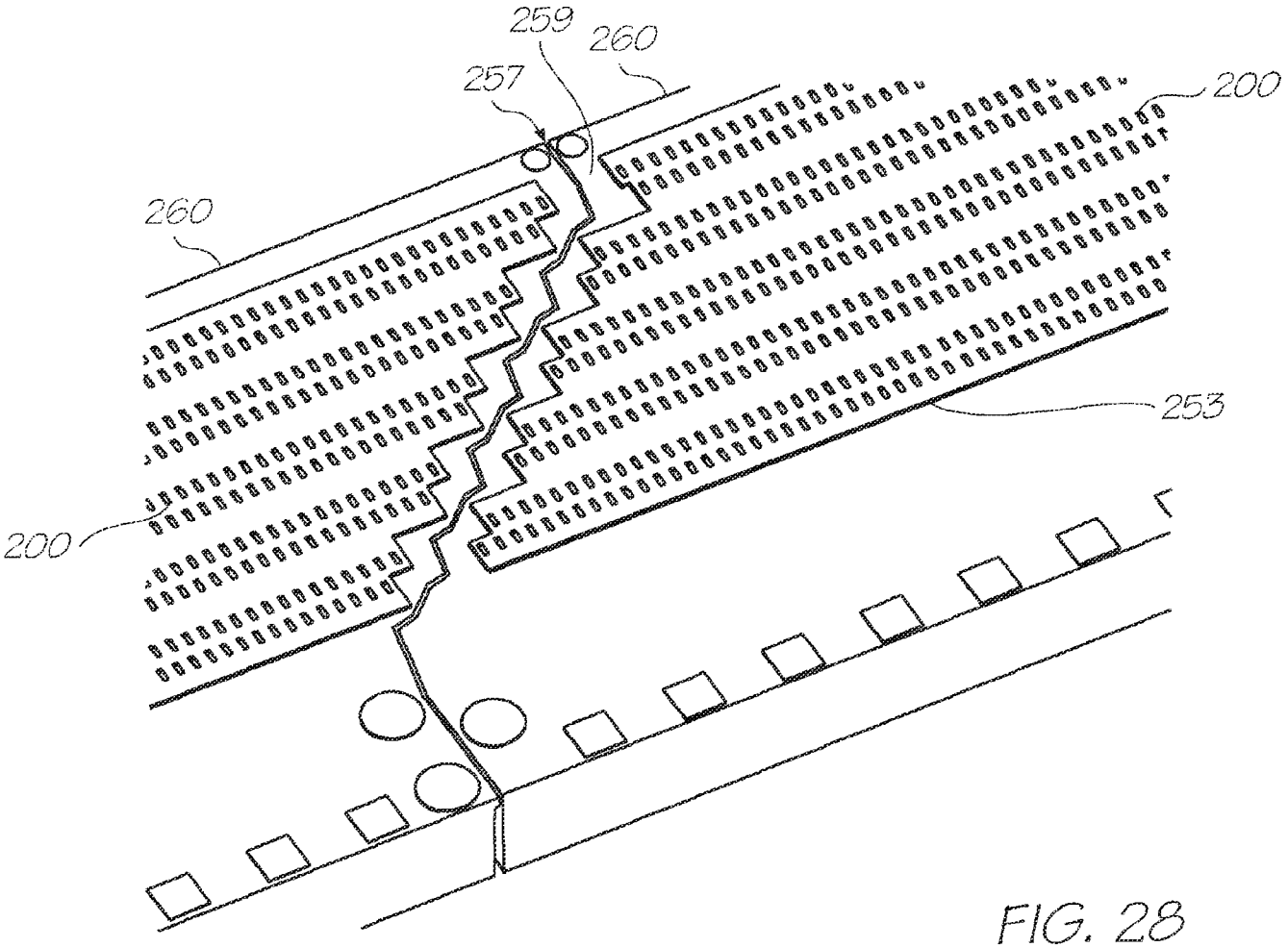
FIG. 28 is a perspective view of a join region for a pair of printhead ICs comprising nozzles configured for printing into the join region.

The nozzle assemblies 200, 210 and 220 described herein, with their ability to eject ink droplets at a plurality of predetermined different dot positions along a longitudinal axis, provide a solution to the problem of joining printhead ICs together whilst maintaining a consistent dot pitch across each join region. Moreover, and as shown in FIG. 28, printhead ICs 260 with uninterrupted nozzle rows (i.e. without the displaced nozzle triangle 253 shown in FIG. 27) may be butted together. This design of printhead IC not only facilitates the supply of ink along each nozzle row, but also improves wafer yields. In principle, there are two possible approaches which may be employed to compensate for 'absent' nozzles spanning across the join region 257.

Figure 29:
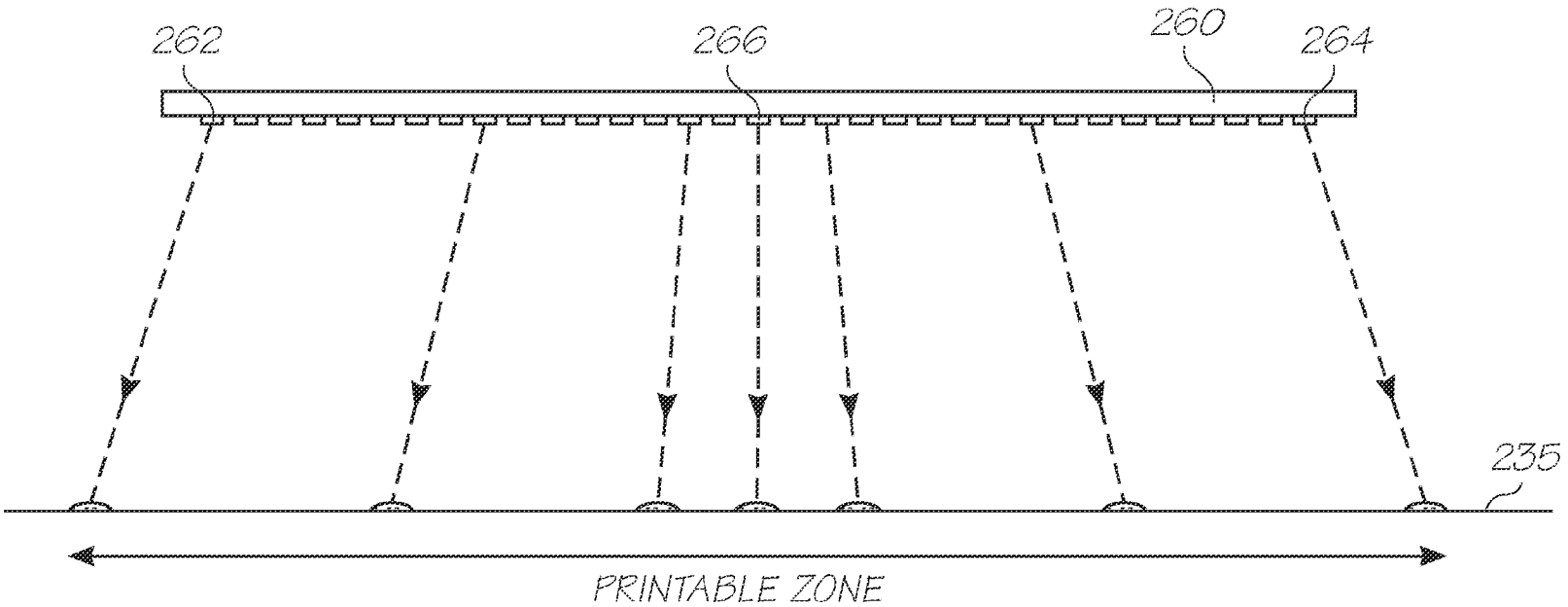
FIG. 29 is a side view of a printhead IC where a printable zone is longer than a corresponding nozzle row.

In a first approach, nozzles positioned towards either end of the printhead IC 260 are configured to eject ink droplets skewed towards a respective end, whilst nozzles positioned towards the centre of the printhead IC 260 eject ink droplets normal to the ink ejection face. Referring to FIG. 29, there is shown a printhead IC 260 where nozzles 264 positioned towards the right-hand edge are configured to eject ink droplets skewed towards the right-hand edge. Similarly, nozzles positioned 262 towards the left-hand edge are configured to eject ink droplets skewed towards the left-hand edge. Nozzles 266 positioned towards the centre of the printhead IC are configured to eject ink droplets normal to the ink ejection face. Although nozzles 262, 264 and 266 have different droplet ejection characteristics, they are of course all identical in the sense that they are nozzles of the type shown in FIG. 18, 19 or 20 with an inherent ability to control droplet direction.

The degree of skew is dependent on the distance of a particular nozzle from the centre of the printhead IC 260. Those nozzles positioned at the extremities of the printhead IC are configured to eject ink droplets skewed more than those nozzles positioned towards the centre of the printhead IC. This gradual flaring outwards from the centre of the printhead IC 260 enables a consistent dot pitch to be maintained across the length of the printhead IC.

Although the 'flaring' of droplet ejection is shown exaggerated in FIG. 29, it will be appreciated that the average dot pitch of ejected ink droplets may be slightly larger than the nozzle pitch of the printhead IC 260 as a consequence of this flaring. However, with hundreds or thousands of nozzles in each nozzle row, the consequent reduction in dot density relative to nozzle density will be negligible. Typically, the average dot pitch will be less than 1% larger than the nozzle pitch of the printhead, notwithstanding the flared droplet ejection.

By virtue of the skewed droplet ejection at the edges of the printhead IC 260, the actual printable zone of a particular nozzle row is longer than the length of that nozzle row. The printable zone may be from 1 to 8 nozzle pitches longer than the nozzle row. This extended printable zone allows the printhead IC to print into the join region 257 between abutting printhead ICs 260, thereby obviating the displaced nozzle triangle 253 shown in FIG. 27.

Of course, it is equally possible for only nozzles positioned at one end of the printhead IC to have skewed droplet ejection. However, given the width of a typical join region 257 (i.e. a width between nozzles from a pair of butting printhead ICs which are in the same nozzle row), the arrangement shown in FIG. 29 with flared droplet ejection is typically preferred. This maximizes the extent to which abutting pairs of printhead ICs can compensate for 'absent' nozzles in the join region 257.

The printhead IC 260 shown in FIG. 29, with flared droplet ejection, has the advantage that, in the absence of dead nozzle compensation or a requirement to print at higher dot densities, each nozzle fires only once within one line-time whilst extending the length of the printable zone beyond the length of a corresponding nozzle row. In an alternative approach, a printhead IC 270 may be configured such that selected nozzles at the extremities of each nozzle row fire more than once within one line-time so as to compensate for 'absent' nozzles in the join region.

Figure 30:
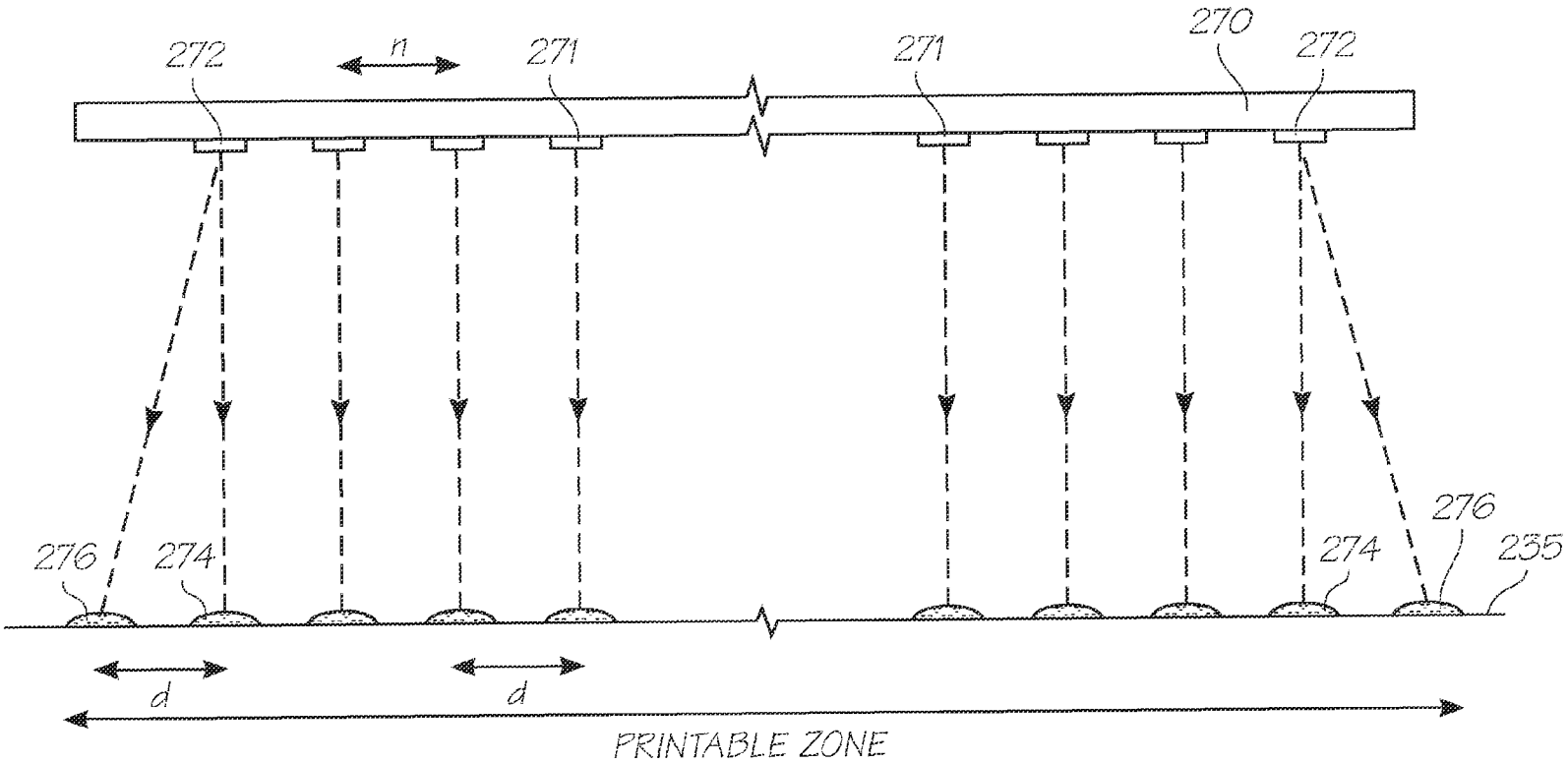
FIG. 30 is a side view of a printhead IC where end nozzles are configured for printing into respective join regions.

Referring to FIG. 30, there is shown the printhead IC 270 where most nozzles eject ink droplets normal to the ink ejection face of the printhead IC. However, at least one nozzle 272 at the extremity of a nozzle row is configured to eject an ink droplet at a primary dot position 274 (i.e. normal to the ink ejection face) and to eject an ink droplet at a secondary dot position 276 which is skewed towards a respective end of the printhead IC. In other words, the nozzles 272 are configured to eject two ink droplets within one line-time, in a similar fashion to the nozzles 231 in the high density printhead 230. However, a consistent dot pitch d is maintained by the nozzles 272 so that the nozzle pitch n is typically equal to the dot pitch d across the whole printable zone of the printhead IC 270.

Although the printhead IC 270 has the advantage that there is no sacrifice of dot pitch relative to nozzle pitch, it has the disadvantage that the nozzles 272 at the extremities of each nozzle row are required to eject ink at twice the frequency of the other nozzles 271. As a consequence, the nozzles 272 are more susceptible to failure by fatigue and the printhead IC 260 is therefore more generally preferred as a solution for butting printhead ICs together.

Improved MEMS/CMOS Integration

An important aspect of MEMS printhead design is the integration of MEMS actuators with underlying CMOS drive circuitry. In order for a nozzle actuation to occur, current from a drive transistor in the CMOS drive circuitry layer must flow up into the MEMS layer, through the actuator and back down to the CMOS drive circuitry layer (e.g. to a ground plane in the CMOS layer). With several thousand actuators in one printhead IC, the efficiency of current flow paths should be maximized so as to minimize losses in overall printhead efficiency.

Hitherto, the Applicant has described nozzle assemblies having a pair of linear posts extending between a MEMS actuator (positioned in the nozzle chamber roof) and an underlying CMOS drive circuitry layer. Indeed, the fabrication of such parallel actuator posts is shown in FIGS. 5 and 6, and described herein. Linear copper posts extending up to the MEMS layer, as opposed to more tortuous current pathways, have been shown to improve printhead efficiency. Nevertheless, there is still scope for improving the electrical efficiency of the Applicant's MEMS printheads (and printhead ICs).

One problem associated with controlling several thousand actuations from common CMOS power and ground planes is known as 'ground bounce'. Ground bounce is a well known problem in integrated circuit design, which is particularly exacerbated by having a large number of devices powered between common power and ground planes. Ground bounce usually describes an unwanted voltage drop across either a power or ground plane, which may arise from many different sources. Typical sources of ground bounce include: series resistance ("IR drop"), self-inductance, and mutual inductance between ground and power planes. Each of these phenomena may contribute to ground bounce by undesirably decreasing the potential difference between power and ground planes. This decreased potential difference inevitably results in reduced electrical efficiency of the integrated circuit, more particularly the printhead IC in the present case. It will be appreciated that the arrangement and configuration of power and ground planes, as well as connections thereto, can fundamentally affect ground bounce and the overall efficiency of a printhead.

Figure 31:
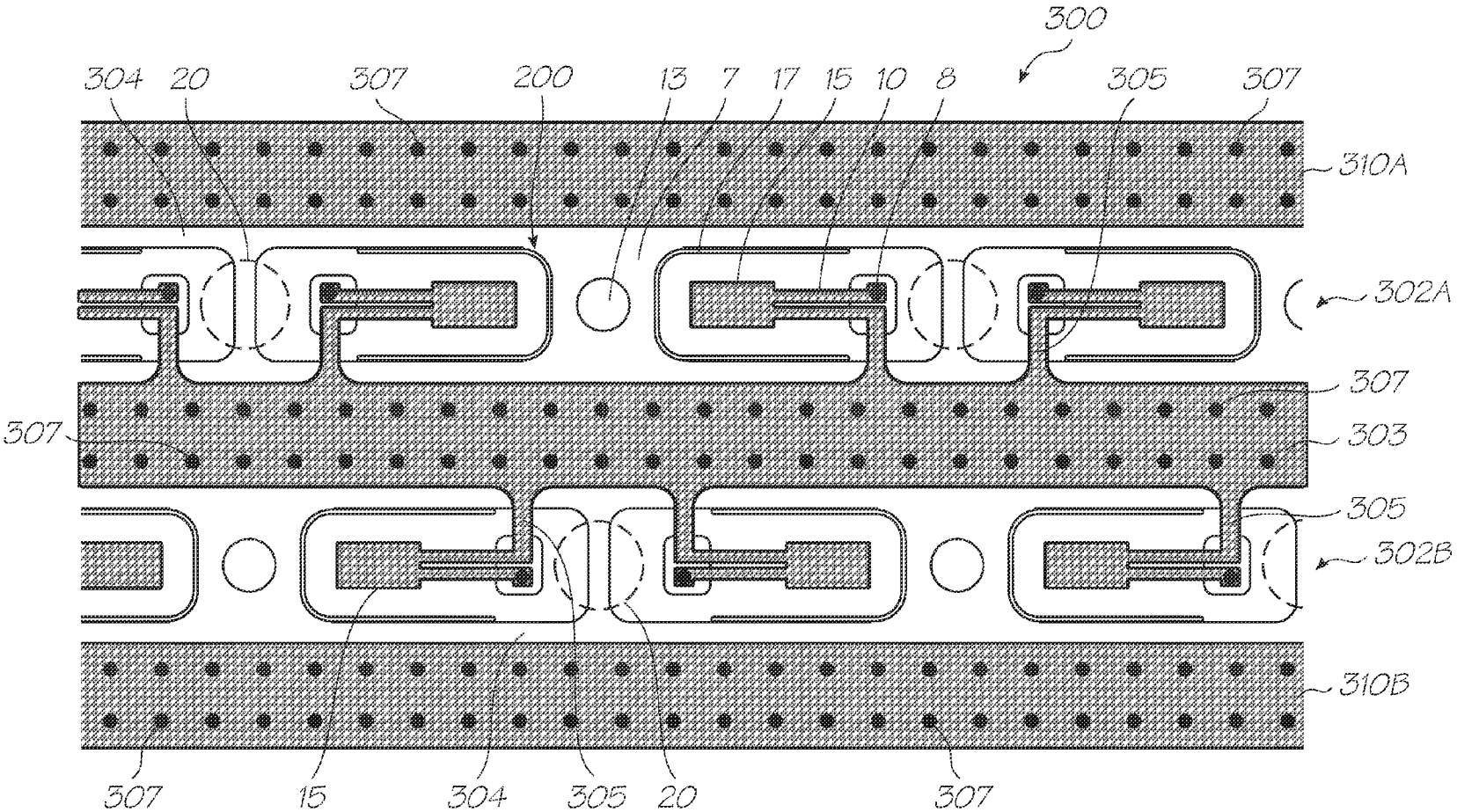
FIG. 31 is a plan view of a part of a printhead IC having conductive tracks disposed on a nozzle plate.

Referring to FIG. 31, there is shown in plan view part of a printhead IC 300 having conductive tracks extending longitudinally and parallel with nozzle rows. The uppermost polymer layer 19 has been removed for clarity in FIG. 31.

A plurality of nozzles 210 (described in detail in connection with FIG. 18) are arranged in nozzle rows extending along a longitudinal axis of the printhead IC 300. FIG. 31 shows a pair of nozzle rows 302A and 302B, although the printhead IC 300 may of course comprises more nozzle rows. The nozzle rows 302A and 302B are paired and offset from each other, with one nozzle row 302A being responsible for printing 'even' dots and the other nozzle row 302B being responsible for printing 'odd' dots. Nozzle rows are typically paired in this way in the Applicant's printheads, as can be seen more clearly in, for example, FIG. 28.

A first conductive track 303 is positioned between the nozzle rows 302A and 302B. The first conductive track 303 is deposited on the nozzle plate 304 of the printhead IC 300, which defines the nozzle chamber roofs 7 (see FIG. 10). Thus, the first conductive track 303 is generally coplanar with the thermoelastic beams 10 of the actuators 15 and may be formed during MEMS fabrication by co-deposition with the thermoelastic beam material (e.g. vanadium-aluminium alloy). Conductivity of the conductive track 303 may be further improved by deposition of another conductive metal layer (e.g. copper, titanium, aluminium etc) during MEMS fabrication. For example, it will be appreciated that a metal layer may be deposited prior to deposition of the thermoelastic beam material (e.g. co-deposited with the metal pads 9 shown in FIG. 8). A simple modification of the etch mask for the metal pads 9 may be used define the conductive track 303. Hence, the conductive track 303 may comprise multiple metal layers so as to optimize conductivity.

Each actuator 15 has a first terminal directly connected to the first conductive track 303 via a transverse connector 305. As will be seen in FIG. 31, each actuator from both nozzle rows 302A and 302B has a first terminal connected to the first conductive track 303. The first conductive track 303 is connected to a common reference plane in the underlying CMOS drive circuitry layer via a plurality of conductor posts 307, which are fabricated analogously to the actuator posts 8 described above in connection with FIG. 6. Thus, the conductive track 303 may extend continuously along the printhead IC 300 to provide a common reference plane for each actuator in the pair of nozzle rows. As will be discussed in more detail below, the common reference plane between the nozzle rows 302A and 302B may be a power plane or a ground plane, depending on whether nFETs or pFETs are employed in the CMOS drive circuitry.

Alternatively, the conductive track 303 may extend discontinuously along the printhead IC 300, with each portion of the conductive track providing a common reference plane for a set of actuators. A discontinuous conductive track 303 may be preferable in cases where delamination of the conductive track is problematic, although the conductive track still functions in the same manner as described above.

A second terminal of each actuator 15 is connected to an underlying drive FET in the CMOS drive circuitry layer via an actuator post 8 extending between the actuator and the CMOS drive circuitry layer. Each actuator post 8 is entirely analogous with the actuators posts 8 shown in FIG. 6 and is formed during MEMS fabrication in the same way. Thus, each actuator 15 is individually controlled by a respective drive FET.

In FIG. 31, a pair of second conductive tracks 310A and 310B also extend longitudinally along the printhead IC 300 and flank the pair of nozzle rows 302A and 302B. The second conductive tracks 310A and 310B complement the first conductive track 303. In other words, if the first conductive track 303 is a power plane, then the second conductive tracks are both ground planes. Conversely, if the first conductive track 303 is a ground plane, then the second conductive tracks are both power planes. The second conductive tracks 310A and 310B are not directly connected to the actuators 15; however, they are connected to a corresponding reference plane (power or ground) in the CMOS drive circuitry layer via a plurality of conductor posts 307.

It will be appreciated that the second conductive tracks 310 may be formed during MEMS fabrication in an entirely analogous manner to the first conductive track 303, as described above. Accordingly, the second conductive tracks 310 are typically comprised of the thermoelastic beam material and may be multiple-layered so as to enhance conductivity.

The first and second conductive tracks 303 and 310 function primarily to reduce the series resistance of corresponding reference planes in the CMOS drive circuitry layer. Thus, by providing conductive tracks in the MEMS layer, which are electrically connected in parallel with corresponding reference planes in the CMOS layer, the overall resistance of these reference planes is significantly reduced by a simple application of Ohm's law. Generally, the conductive tracks are configured so as to minimize their resistance, for example by maximizing their width or depth as far as possible.

The series resistance of a ground plane or a power plane may be reduced by at least 25%, at least 50%, at least 75% or at least 90% by virtue of the conductive tracks in the MEMS layer. Likewise, the self-inductance of a ground plane or a power plane may be similarly reduced. This significant reduction in series resistance and self-inductance of both ground and power planes helps to minimize ground bounce in the printhead IC 300 and therefore improves printhead efficiency. It is understood by the present inventors that mutual inductance between power and ground planes is also be reduced in the printhead IC 300 shown in FIG. 31, although quantitative analysis of mutual inductance requires complex modeling, which is beyond the scope of this disclosure.

Figure 33:
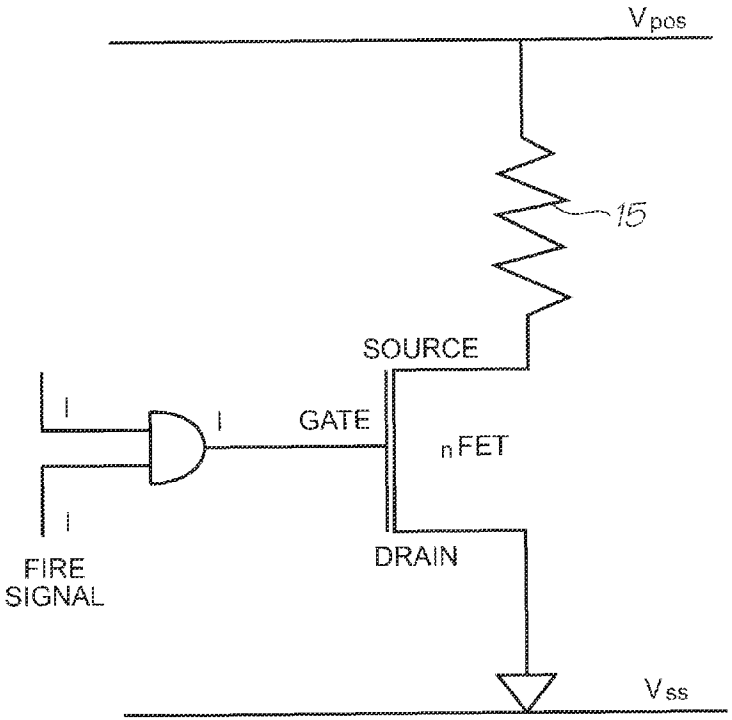
FIG. 33 is a simplified circuit diagram for an actuator connected to a drive nFET.
Figure 32:
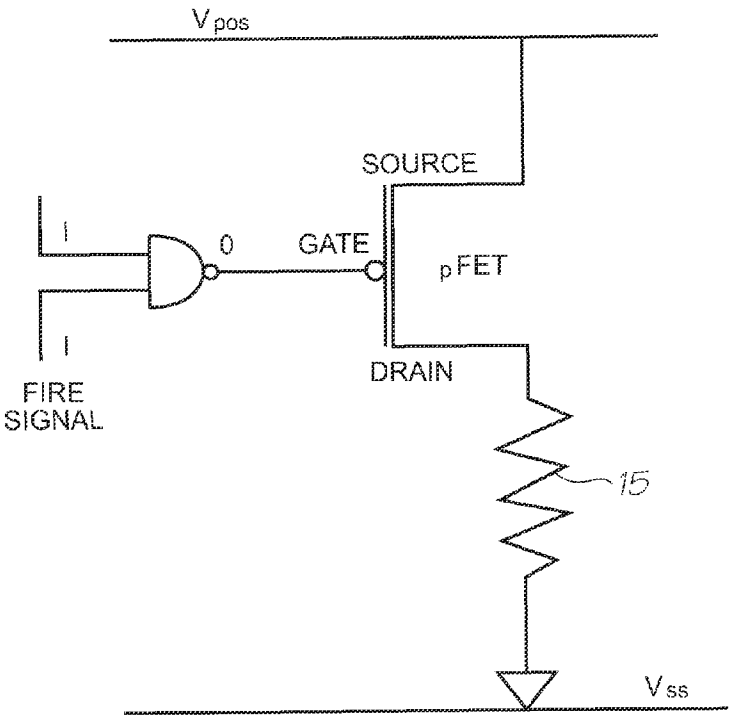
FIG. 32 is a simplified circuit diagram for an actuator connected to a drive pFET.

FIGS. 32 and 33 provide simplified CMOS circuit diagrams for a pFET and a nFET drive transistor. The drive transistor (either nFET or pFET) is directly connected to the second terminal of each actuator 15 via the actuator post 8, as shown in FIG. 31.

In FIG. 32, the actuator 15 is connected between the drain of a pFET and the ground plane ("Vss"). The power plane ("Vpos") is connected to the source of the pFET, while the gate receives the logic fire signal. When the pFET receives a low voltage at the gate (by virtue of the NAND gate), current flows through the pFET so that the actuator 15 is actuated. In the pFET circuit, the first terminal of the actuator is connected to the ground plane provided by the first conductive track 303, while the second terminal of the actuator is connected to the pFET. Hence, the second conductive tracks provide power planes.

In FIG. 33, the actuator 15 is connected between the power plane ("Vpos") and the source of a nFET. The ground plane ("Vss") is connected to the drain of the nFET, while the gate receives the logic fire signal. When the nFET receives a high voltage at the gate (by virtue of the AND gate), current flows through the nFET so that the actuator 15 is actuated. In the nFET circuit, the first terminal of the actuator is connected to the power plane provided by the first conductive track 303, while the second terminal of the actuator is connected to the nFET. Hence, the second conductive tracks provide ground planes.

From FIGS. 32 and 33, it will be appreciated that the first and second conductive tracks 303 and 310 are compatible with either pFETs or nFETs.

Of course, the advantages of using conductive tracks, as described above, are not in any way limited to the nozzles 210 shown in FIG. 31. Any printhead IC with any type of actuator can, in principle, benefit from the conductive tracks described above.

Figure 34:
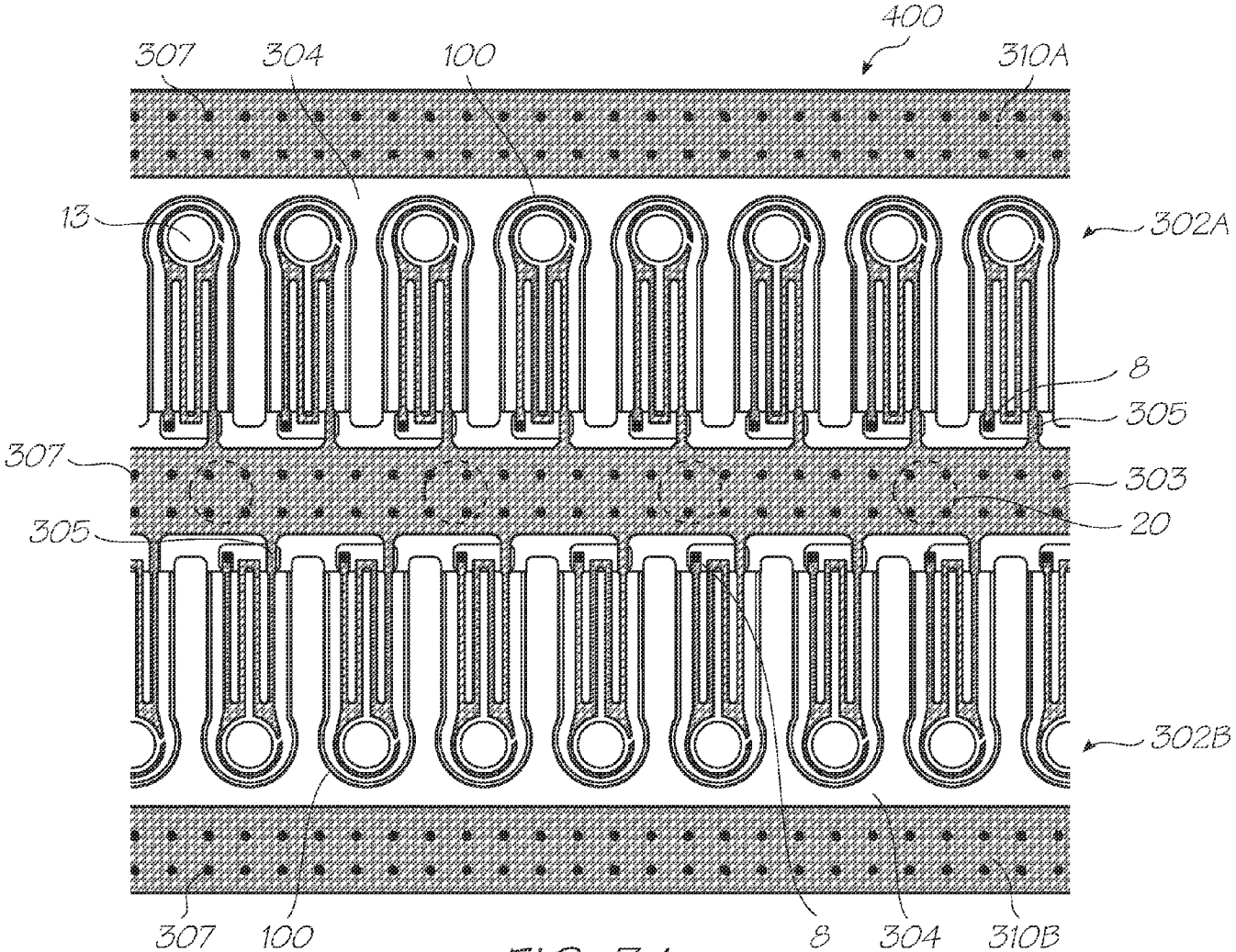
FIG. 34 is a plan view of a part of an alternative printhead IC having conductive tracks disposed on a nozzle plate.

FIG. 34 shows a printhead IC 400 comprising a plurality of nozzles 100 (of a similar type to those described in connection with FIG. 16) arranged in a longitudinally extending pair of nozzle rows 302A and 302B. The first conductive track 303 extends between the pair of nozzle rows 302A and 302B, and the second conductive tracks 310A and 310B flank the pair of nozzle rows. Each actuator 15 of a respective nozzle 100 has a first terminal connected to the first conductive track 303 via a transverse connector 305, and a second terminal is connected to an underlying FET via an actuator post 8. It will therefore be appreciated that the printhead IC 400 functions analogously to the printhead IC 300 in the sense that the conductive tracks 303 and 310 provide common reference planes by virtue of connections to corresponding reference planes in underlying CMOS drive circuitry. Moreover, the first conductive track 303 is directly connected to one terminal of each actuator so as to provide a common reference plane for each actuator in both nozzle rows 302A and 302B.

It will be appreciated by ordinary workers in this field that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A method of controlling a direction of droplet ejection from an inkjet nozzle, said inkjet nozzle comprising a nozzle chamber having a roof with a nozzle opening defined therein and a plurality of moveable paddles defining at least part of the roof, each paddle including a thermal bend actuator, said method comprising the steps of:

actuating a first thermal bend actuator via respective first drive circuitry such that a respective first paddle bends towards a floor of said nozzle chamber;

actuating a second thermal bend actuator via respective second drive circuitry such that a respective second paddle bends towards a floor of said nozzle chamber; and thereby ejecting a droplet of ink from said nozzle opening, wherein actuation of said first and second thermal bend actuators is independently controlled via said first and second drive circuitry so as to control the direction of droplet ejection from said nozzle opening.

2. The method of claim 1, wherein said first and second actuators are independently controlled by controlling at least one of:

a timing of drive signals to each of said first and second actuators so as to provide a coordinated movement of said plurality of paddles; and a power of drive signals to each of said actuators so as to cause asymmetric movement of said plurality of paddles.

3. The method of claim 2, wherein either said first actuator is actuated prior to said second actuator to provide droplet ejection in a first direction, or said second actuator is actuated prior to said first actuator to provide droplet ejection in a second direction.

4. The method of claim 2, wherein either said first actuator is supplied with more power than said second actuator, or said second actuator is supplied with more power than said first actuator.

5. The method of claim 2, wherein the power of drive signals is controlled by at least one of:

a voltage of said drive signals; and a pulse width of said drive signals.

6. The method of claim 1, wherein a pair of opposed paddles are positioned on either side of said nozzle opening.

7. The method of claim 1, wherein two pairs of opposed paddles positioned relative to said nozzle opening.

8. The method of claim 7 comprising the further steps of:

actuating a third thermal bend actuator via respective first drive circuitry such that a respective third paddle bends towards a floor of said nozzle chamber;

actuating a fourth thermal bend actuator via respective second drive circuitry such that a respective second paddle bends towards a floor of said nozzle chamber, wherein actuation of said first, second, third and fourth thermal bend actuators is independently controlled via respective first, second, third and fourth drive circuitry so as to control the direction of droplet ejection from said nozzle opening.

9. The method of claim 1, wherein said paddles are moveable relative to said nozzle opening.

10. The method of claim 1, wherein each paddle defines a segment of said nozzle opening such that said nozzle opening and said paddles are moveable relative to said floor.

11. The method of claim 1, wherein each thermal bend actuator comprises:

an upper thermoelastic beam connected to respective drive circuitry; and a lower passive beam fused to said thermoelastic beam, such that when a current is passed through the thermoelastic beam, the thermoelastic beam expands relative to the passive beam, resulting in bending of a respective paddle towards the floor of the nozzle chamber.

12. The method of claim 11, wherein said thermoelastic beam is comprised of a vanadium-aluminium alloy.

13. The method of claim 11, wherein said passive beam is comprised of at least one material selected from the group consisting of: silicon oxide, silicon nitride and silicon oxynitride.

14. The method of claim 11, wherein said passive beam comprises a first upper passive beam comprised of silicon oxide and a second lower passive beam comprised of silicon nitride.

15. The method of claim 1, wherein said roof is coated with a polymeric material, said polymeric material providing a mechanical seal between each paddle and a stationary part of said roof, thereby minimizing ink leakage during actuation of said paddles.

16. The method of claim 15, wherein said polymeric material is comprised of a polymerized siloxane.

17. The method of claim 16, wherein the polymerized siloxane is selected from the group consisting of: polysilsesquioxanes and polydimethylsiloxane.

18. The method of claim 1, wherein said inkjet nozzle is one of a plurality of nozzles in an inkjet printhead.

* * * * *